US009176476B2

(12) United States Patent
Loeffel et al.

(10) Patent No.: US 9,176,476 B2
(45) Date of Patent: Nov. 3, 2015

(54) AUTONOMOUS CONTROL MECHANISM FOR A TIMEPIECE

(75) Inventors: Raphael Loeffel, Le Landeron (CH); Ivan Villar, Bienne (CH); Marco Bettelini, Preles (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 65 days.

(21) Appl. No.: 13/596,723

(22) Filed: Aug. 28, 2012

(65) Prior Publication Data

US 2013/0051194 A1 Feb. 28, 2013

(30) Foreign Application Priority Data

Aug. 29, 2011 (EP) ..... 11179180

(51) Int. Cl.
*G04B 27/04* (2006.01)
*G04B 27/00* (2006.01)

(52) U.S. Cl.
CPC ..... *G04B 27/04* (2013.01); *G04B 27/001* (2013.01)

(58) Field of Classification Search
CPC .... G04B 27/02; G04B 27/023; G04B 27/026; G04B 27/04; G04B 27/045; G04B 27/06; G04B 27/065; G04B 27/08; G04B 27/083
USPC ..... 368/74, 190–192, 306, 308, 319, 324
See application file for complete search history.

(56) References Cited

U.S. PATENT DOCUMENTS

| | | | | |
|---|---|---|---|---|
| 78,720 | A * | 6/1868 | Chatelain | 368/190 |
| 3,987,618 | A * | 10/1976 | Barth | 368/185 |
| 6,295,249 | B1 * | 9/2001 | Takahashi et al. | 368/35 |
| 6,499,874 | B2 * | 12/2002 | Graemiger | 368/190 |
| 7,494,269 | B2 * | 2/2009 | Ryter | 368/190 |
| 7,794,138 | B2 * | 9/2010 | Hilfiker | 368/190 |
| 7,905,655 | B2 * | 3/2011 | Jolidon | 368/101 |
| 7,980,756 | B2 * | 7/2011 | Graemiger et al. | 368/192 |
| 8,439,558 | B2 * | 5/2013 | Pittet | 368/192 |

FOREIGN PATENT DOCUMENTS

| | | |
|---|---|---|
| CH | 17991 A | 9/1899 |
| CH | 124382 A | 1/1928 |
| EP | 2 124 112 A1 | 11/2009 |
| FR | 502 655 A | 5/1920 |

* cited by examiner

*Primary Examiner* — Sean Kayes
(74) *Attorney, Agent, or Firm* — Sughrue Mion, PLLC

(57) ABSTRACT

Autonomous control mechanism (100) for a movement, comprising a control stem (10) moveable relative to a bar (80) between stable stem positions, for controlling the pivoting, in each of said positions, of a single control train of the control trains of said mechanism (100).
It includes, on a first side (81) of said bar (80), a first control train (810), and on a second side (82) opposite said bar (80), a second control train (820). Every stable position of the control stem (10) drives a stable position of a pull-out piece (20) fitted to one of said sides and moveable relative to a boss (210) of said bar (80). In said stable pull-out piece position, any movement applied to the control stem (10) causes the pivoting movement, of either a single first control train (810), or a single second control train (820).

14 Claims, 17 Drawing Sheets

AUTONOMOUS CONTROL MECHANISM FOR A TIMEPIECE

This application claims priority from European Patent Application No. 11179180.2 filed Aug. 29, 2011, the entire disclosure of which is incorporated herein by reference.

FIELD OF THE INVENTION

The invention concerns an autonomous timepiece control mechanism, comprising, on a first side of a main bar or bridge, at least one first control train, and on a second side of said main bar, at least one second control train, and at least one control stem, which is moveable relative to said main bar between a plurality of stable positions, in order to pivot, in each said stable position, a single one of said control trains. Said stem controls the positioning of a pull-out piece, which is fitted to one side of said main bar and moveable relative to a boss of said main bar, in a stable position of the pull-out piece associated with each said stable position of the stem, and in which any movement applied to said stem by the user causes the pivoting movement of either one said first control train, or one said second control train. Said stem comprises guide means cooperating with complementary guide means of a sliding pinion for the translation of said pinion on said stem and for pivoting said sliding pinion integrally with said stem. Said sliding pinion comprises a first driving means arranged to drive one said first control train and a second driving means arranged to drive one said second control train.

The invention also concerns a timepiece movement including at least one such autonomous timepiece control mechanism.

The invention also concerns a timepiece including at least one such autonomous control mechanism or including a timepiece movement of this type.

The invention concerns the field of horology.

BACKGROUND OF THE INVENTION

Numerous control mechanisms used in horology comprise a large number of components, the arrangement of which is ill suited to the automated assembly required in mass production.

The particular case of a winding mechanism is usually linked to a particular assembly sequence, which generally means that the stem cannot be changed once the movement has been fitted. This is incompatible with a modular design, in which it is desired to be able to use a particular module or calibre for several different products.

FR Patent Application No. 502 655 A in the name of JULES RUSSBACH discloses a watch movement with a winding and set hands mechanism removably mounted on a fixed support relative to the frame of the movement, between two bottom plates of the frame, with an intermediate wheel of said mechanism being constantly in a meshing relation with the intermediate wheel controlling the under-dial work.

CH Patent Application No. 17 991 A in the name of GROSJEAN FILS discloses a bar for watches with a winding mechanism, on which all the parts forming the winding and set hands mechanism are placed, secured to the bottom plate of the watch.

CH Patent Application No. 124 382 A in the name of ANNEN ROBERT discloses a movement where the winding and set hands mechanism is mounted in an intermediate part housed between the bottom plate and the bars and acting as a heel for a certain number of said bars.

EP Patent Application No. 2 124 111 A1 in the name of CT TIME discloses an actuating module, intended to be mounted on a frame, and containing a mechanism which includes a control stem, a control pinion rotating integrally with said stem, and an actuating member arranged to cooperate with the control pinion when the stem occupies one of its axial positions. This control pinion is integral in translation with the stem when it moves from one position to the other. This module comprises an independent case containing the mechanism, and a connecting means which comes out of the case and is arranged to kinematically connect the actuating member to the element of the movement to be actuated, so that the actuating member can actuate said element regardless of the position of the module on the movement frame.

SUMMARY OF THE INVENTION

The invention proposes to develop an autonomous control mechanism, particularly, but not limited to a winding mechanism, which forms an independent module and which is suited to automated assembly. The developed mechanism contains the fewest possible components and must be reliable and robust. It must also lend itself easily to after-sales operations, for example changing the stem, without completely uncasing the movement.

The invention therefore concerns an autonomous timepiece control mechanism, comprising, on a first side of a main bar, at least one first control train, and on a second side of said main bar, at least one second control train, and at least one control stem, which is moveable relative to said main bar between a plurality of stable positions, in order to pivot, in each said stable position, a single one of said control trains. Said stem controls the positioning of a pull-out piece, which is fitted to one side of said main bar and moveable relative to a boss of said main bar, in a stable position of the pull-out piece associated with each said stable position of the stem, and in which any movement applied to said stem by the user causes the pivoting movement of either one said first control train, or one said second control train. Said stem comprises guide means cooperating with complementary guide means of a sliding pinion for the translation of said pinion on said stem and for pivoting said sliding pinion integrally with said stem. Said sliding pinion comprises a first driving means arranged to drive one said first control train and a second driving means arranged to drive one said second control train. The invention is characterized in that, fitted to one side of said main bar opposite the side carrying said pull-out piece, the control mechanism includes a lever arranged to carry a second idle wheel arranged to cooperate with said second driving means to drive, according to the position of said lever, one said second control train, amongst a plurality of said second control trains or second control driving means.

According to another feature of the invention, said lever is pivotally mounted on a boss or pin comprised in said main bar, and is driven so as to pivot as a result of the movement of said control stem in said longitudinal direction, directly or indirectly via said sliding pinion, and includes an elastic arm, a free end of which comprises bearing surfaces arranged to cooperate in a locking position with a boss or a pin comprised in said main bar.

According to another feature of the invention, said main bar carries a first boss or pivot arranged to guide the pivoting of a first wheel comprised in one of said second control gear trains or said second control driving means, said first wheel being arranged to mesh with said second idle wheel in a first position of said lever, and said main bar carries a second boss or pivot arranged to guide the pivoting of a second wheel comprised in one of said second control trains or second control driving means, said second wheel being arranged to mesh with said second idle wheel in a second position of said lever, and said lever is inserted between said main bar and said first wheel, on the one hand, and said second wheel on the other hand.

According to another feature of the invention, said main bar, includes, on the side that carries said pull-out piece, a stepped stud for guiding a first idle wheel, which is assembled in superposition with respect to said pull-out piece and arranged to cooperate with said first driving means, in order to drive, according to the position of said lever, one said first control train or first control driving means, said stepped stud including an almond-shaped profile to allow the positioning of said first idle wheel between two end positions, one in which said first idle wheel is meshed with said first driving means, and the other in which said first idle wheel is disengaged from said first driving means.

According to another feature of the invention, said main bar carries a second boss or pivot arranged to guide the pivoting of an intermediate wheel meshed with said first idle wheel, and pressed onto said main bar.

The invention further concerns a timepiece movement comprising at least one autonomous control mechanism of this type, characterized in that said movement includes a plurality of mechanisms, each arranged to cooperate with one of said first control trains or first control driving means, or with one of said second control trains or second control driving means.

According to another feature of the invention, said mechanism includes, on a first side of said main bar, a first control train including an intermediate ratchet drive wheel for a winding mechanism comprised in said movement, arranged to be actuated by the pivoting of said control stem in a first pushed-in position of said control stem, and, on a second side of said main bar, two second control trains, one including a first control wheel for setting a set hands mechanism comprised in said movement, arranged to be actuated by the pivoting of said control stem in a third pulled-out position of said control stem, and the other including a second control wheel for setting a date mechanism comprised in said movement, arranged to be actuated by the pivoting of said control stem in a second pulled-out position of said control stem.

The invention also concerns a timepiece including at least one such autonomous control mechanism or including a timepiece movement of this type.

BRIEF DESCRIPTION OF THE DRAWINGS

Other features and advantages of the invention will appear upon reading the following detailed description, with reference to the annexed Figures, in which.

DETAILED DESCRIPTION OF PREFERRED EMBODIMENTS

The invention concerns the field of horology, and more specifically the field of timepiece movements.

It is an object of the invention to provide a complete, autonomous control mechanism 100, arranged to be directly mounted in cooperation with other components or sub-assemblies forming a timepiece movement 1000 or a timepiece 2000, particularly a watch.

This autonomous control mechanism 100 is devised to be completely assembled separately from the rest of the movement or timepiece, and to form a versatile module that can be used in various movements or various timepieces.

It is also devised to perform various different control functions, as required. This description more particularly describes a winding mechanism. The mechanism according to the invention is devised to be easily adapted to other control functions. In a non-limiting manner, mechanism 100 may be used to control the winding of the barrel of a movement, to control the winding of a striking barrel, to control the selection and release of a striking mechanism and/or alarm, to control a time zone mechanism or, generally, to control displays other than the main display of the movement or timepiece.

The design of mechanism 100 is intended to achieve a high level of compactness, particularly the smallest possible thickness, and the assembly of all the components on both sides of a main bar 80, with the exception of a control stem 10, which is substantially parallel to said bar, and arranged to be mounted radially or substantially tangentially at the periphery of a timepiece. It is therefore possible for the periphery of a timepiece, even a small timepiece, to be fitted with several mechanisms 100 according to the invention, each one controlling one or several particular functions.

This design endeavours to achieve easy assembly of the components of mechanism 100, preferably normal to main bar 80, which makes an automated assembly easier, particularly with robots, which very considerably reduces production costs. The components are particularly simple, produced by stamping, cutting or injection and are inexpensive. The assembly sequence of the components of mechanism 100 is devised to ensure that they are immediately positioned correctly and held, which then allows them to be handled or turned over by an automated apparatus without any risk of the components being displaced or lost. Mechanism 100 can thus be completely assembled as a finished part. The design provides great ease of assembly and disassembly of the control stem, to facilitate maintenance and after-sales operations.

Thus, the autonomous control mechanism 100 for a timepiece movement or timepiece includes at least one means of selection and/or control, or at least one control stem 10.

Figure 12:
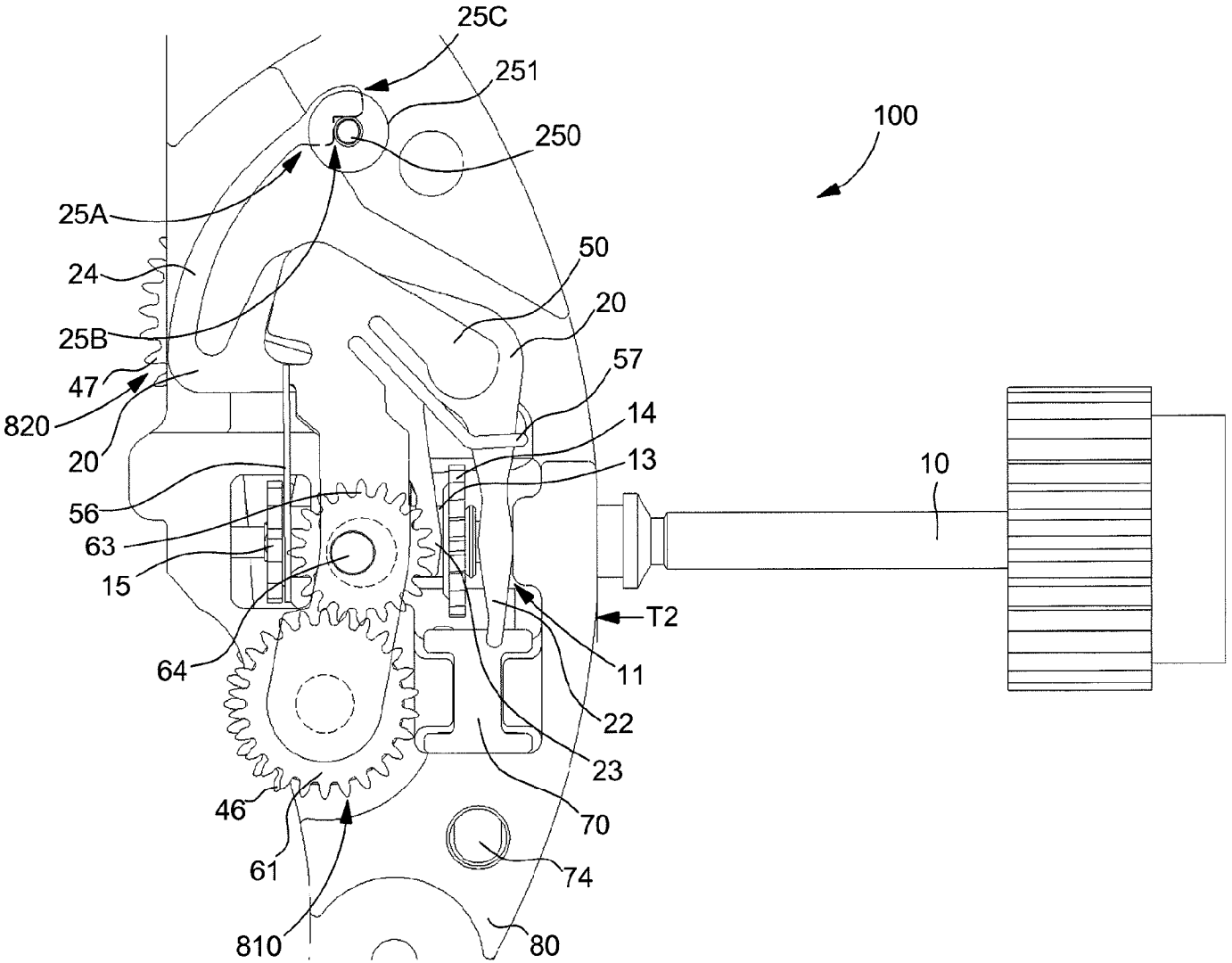
FIGS. 12 and 13 are similar to FIG. 2 and show this mechanism in first and second pulled-out positions of the control stem.
Figure 13:
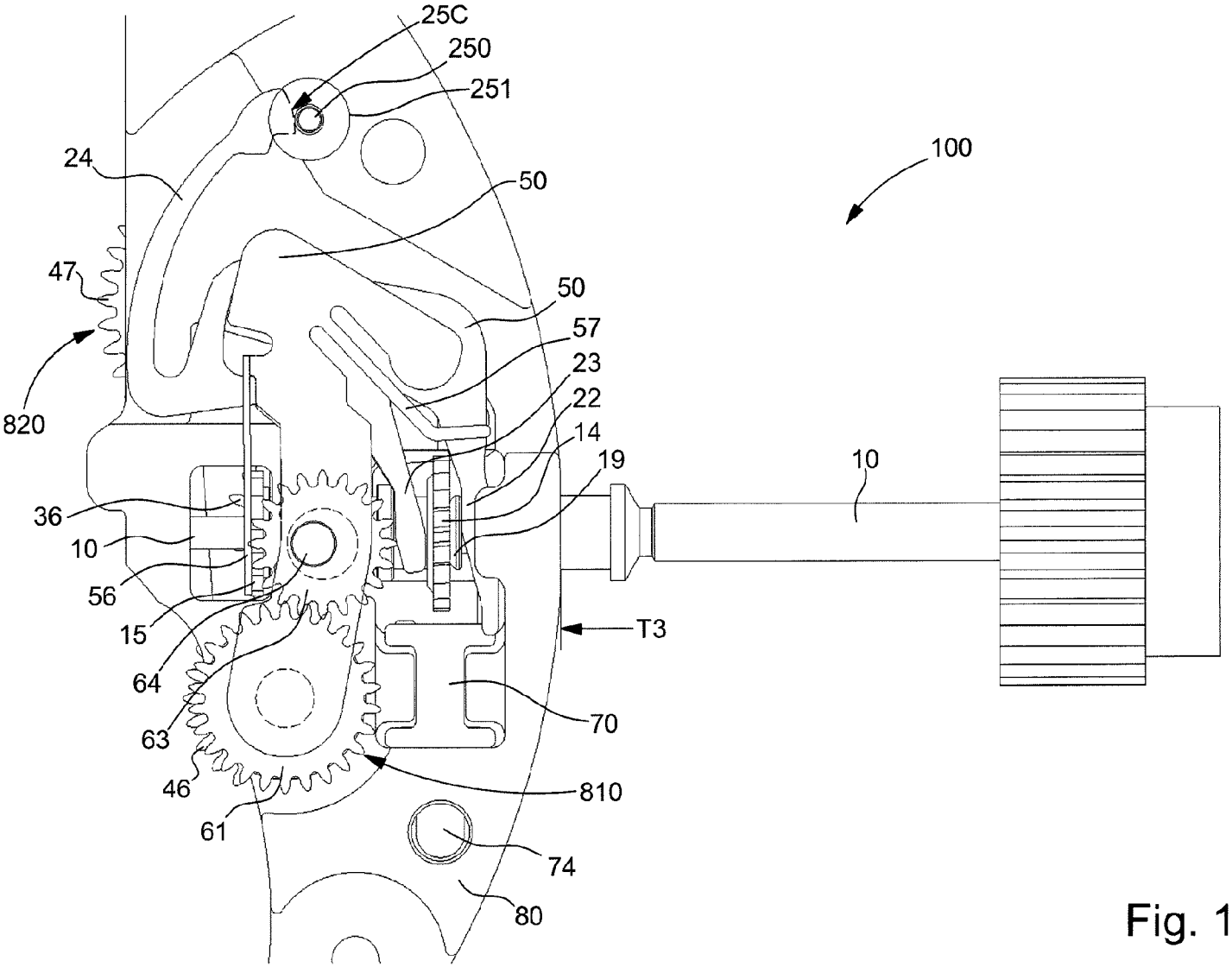
Figure 14:
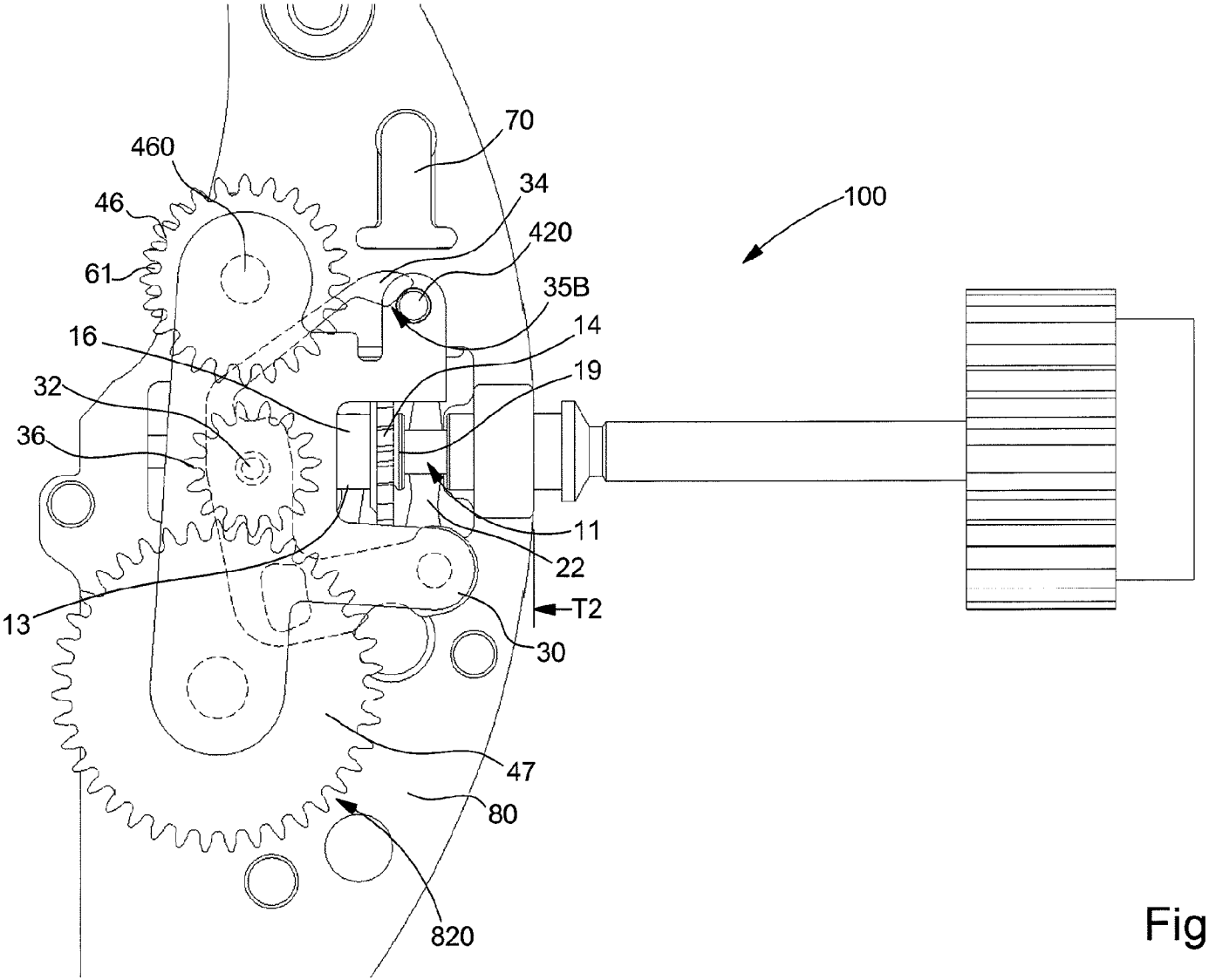
FIGS. 14 and 15 are similar to FIG. 3 and show this mechanism in first and second pulled-out positions of the control stem.
Figure 15:
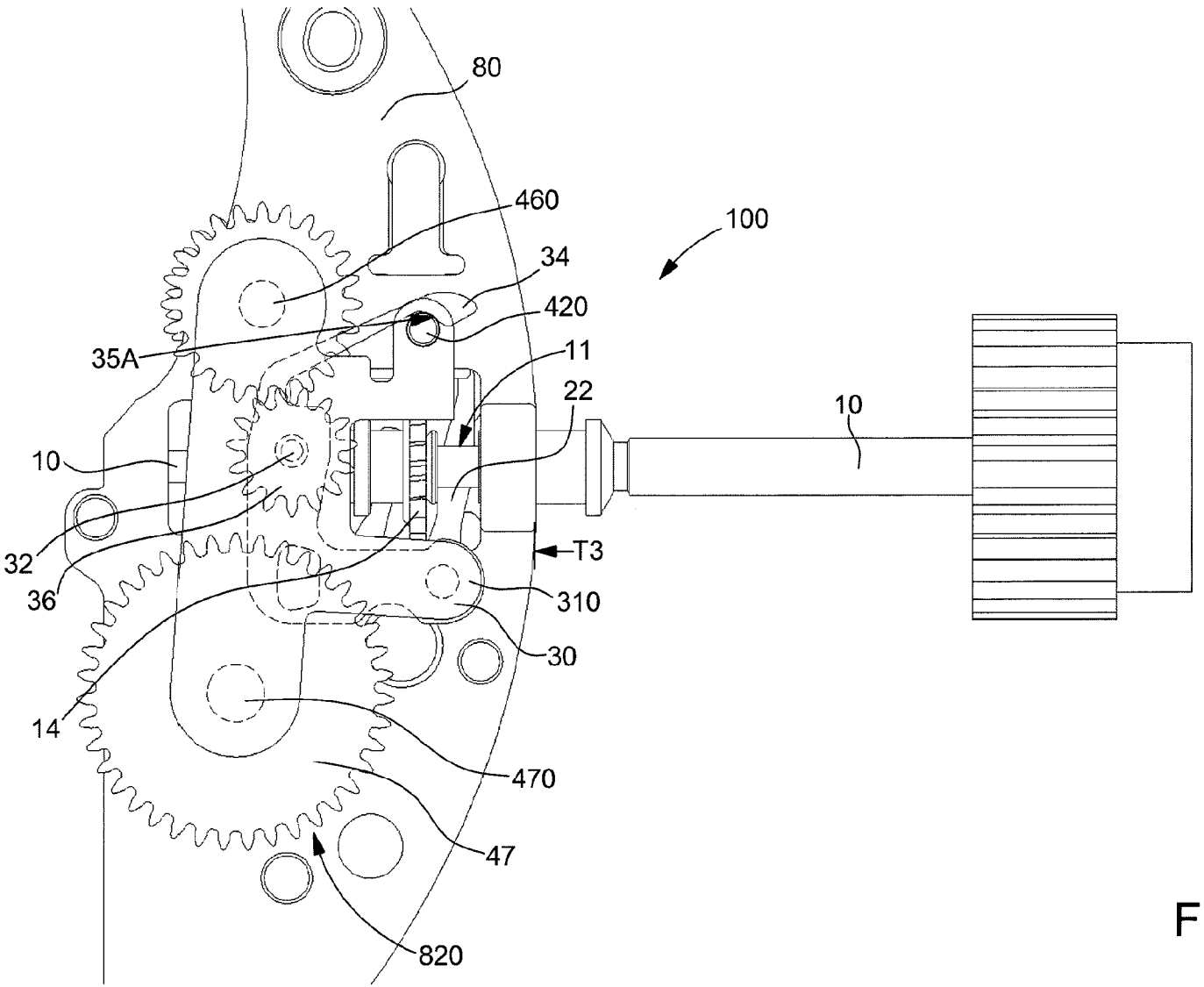
Figure 16:
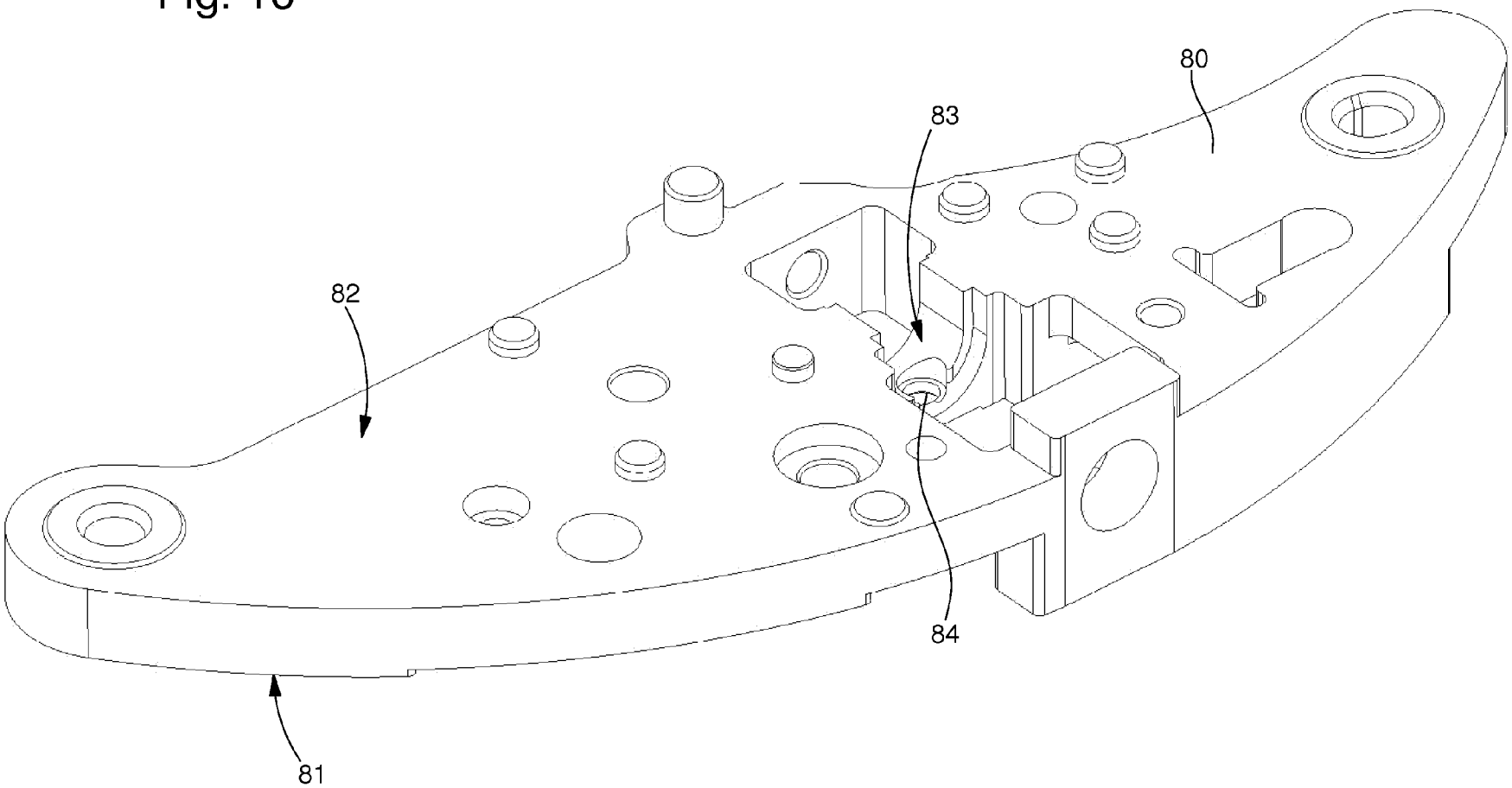
FIG. 16 is a schematic, perspective view of a main bar carrying all of the other components of the mechanism according to the invention.

The invention is more particularly described here with at least one selection and/or control means of this type formed by a control stem 10. This control stem 10 can move with respect to a main bar 80 between a plurality of stable stem positions, for controlling the pivoting, in each stable stem position, of a single control train amongst a plurality of control trains comprised in mechanism 100. FIGS. 2, 2A and 3, 3A illustrate a first pushed-in position T1 of the stem in a conventional configuration wherein the barrel is wound in this position. FIGS. 12 and 14 illustrate a first pulled-out position T2 of control stem 10, for example for setting a date, and FIGS. 13 and 15 illustrate a second pulled-out position T3 of control stem 10, for example for setting the time.

Naturally, it is possible to arrange mechanism 100 with more control positions of control stem 10. For example, to select the mode of a striking mechanism, one position may be provided for each mode: small strike, grand strike, minute repeater, alarm, silence. The associated control operations may then consist in controlling the winding/letting down of the alarm, releasing the grand strike, winding the striking mechanism, and similar operations.

Likewise, control stem 10 is illustrated here with a linear movement in a straight longitudinal direction. However, a circular or other movement may also be envisaged without departing from the invention. Naturally, control stem 10 may also consist of a rack cooperating with a pinion carrying a crown operated by the user.

The present description and the Figures illustrate the preferred case of a single control stem. It is, however, possible to integrate several stems or control members on the same main bar 80, but this particular construction is not described in detail here. In particular, a control stem and a selector could be combined on the same main bar 80, or a reset, time zone display or other control mechanism could be added.

According to the invention, control mechanism 100 comprises, on a first, train side 81 of main bar 80 or bridge, at least a first control train 810 or a first control driving means, for example a cam, a column wheel, a pulley or similar. The invention is more particularly described in a preferred, non-limiting embodiment, comprising transmission by gear trains.

Control mechanism 100 further includes, on a second, dial side 82 of main bar 80, opposite first side 81, at least a second control train 820, or a second control driving means.

Control stem 10 controls the positioning of a pull-out piece 20. This pull-out piece 20 is fitted to the first side 81, here called the "train side", or to the second side 82, called here the "dial side", and is pivotally mobile, via a bore 21 comprised therein, with respect to a boss 210 or pin comprised in main bar 80, in a stable pull-out piece position associated with each stable stem position. The invention is illustrated in the Figures with pull-out piece 20 fitted to the first train side 81, as seen in FIGS. 2, 5, 12 and 13.

According to the invention, in this stable position of the pull-out piece, any movement applied to control stem 10 by the user causes the pivoting movement, of either one first control train 810 or first control driving means, or one second control train 820 or second control driving means.

Pull-out piece 20 has a flexible arm 24, a free end of which includes teeth with oblique faces, defining recesses called notches 25 or 125 for locking the arm in stable positions of the pull-out piece with respect to a boss 250 or pin comprised in main bar 80. In a preferred variant, boss 250 is extended by a washer 251 which is driven and/or welded onto said boss, and performs the function of holding elastic arm 24. Thus, said arm 24 butts on washer 251, when the pull-piece arm 22 is raised.

Figure 1A:
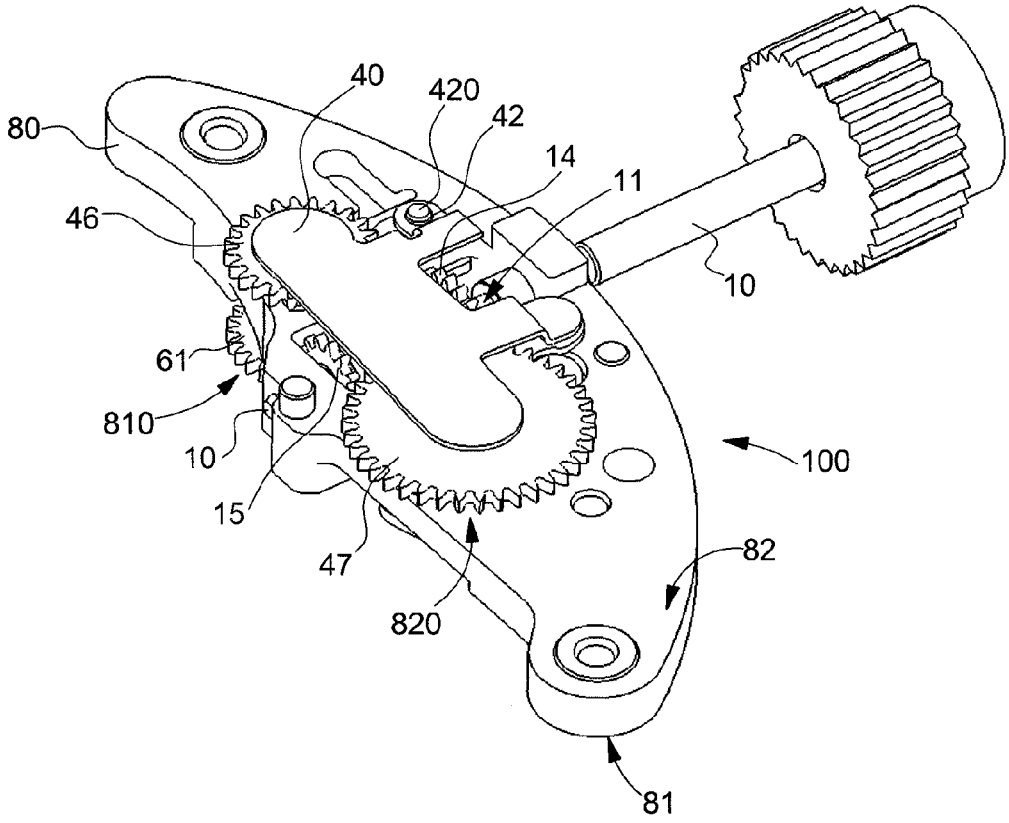
FIG. 1 and FIG. 1A show schematic and perspective views of an autonomous control mechanism for a timepiece movement according to the invention, seen respectively from a first side, called the train side, and from a second side, called the dial side, opposite said first, train side.
Figure 1:
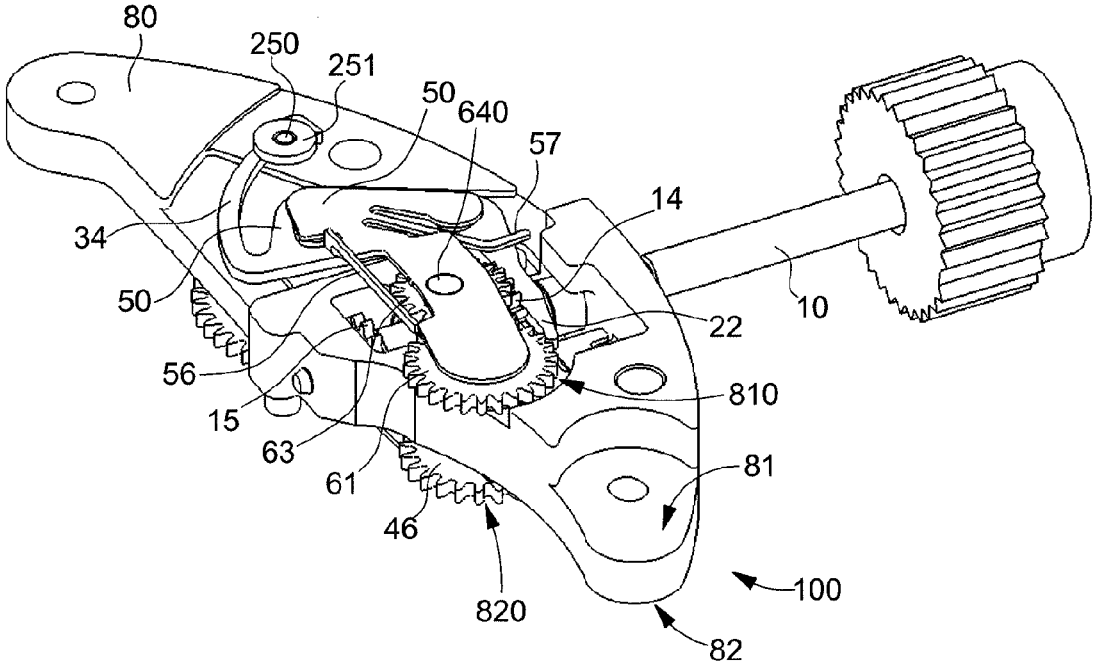
Figure 2:
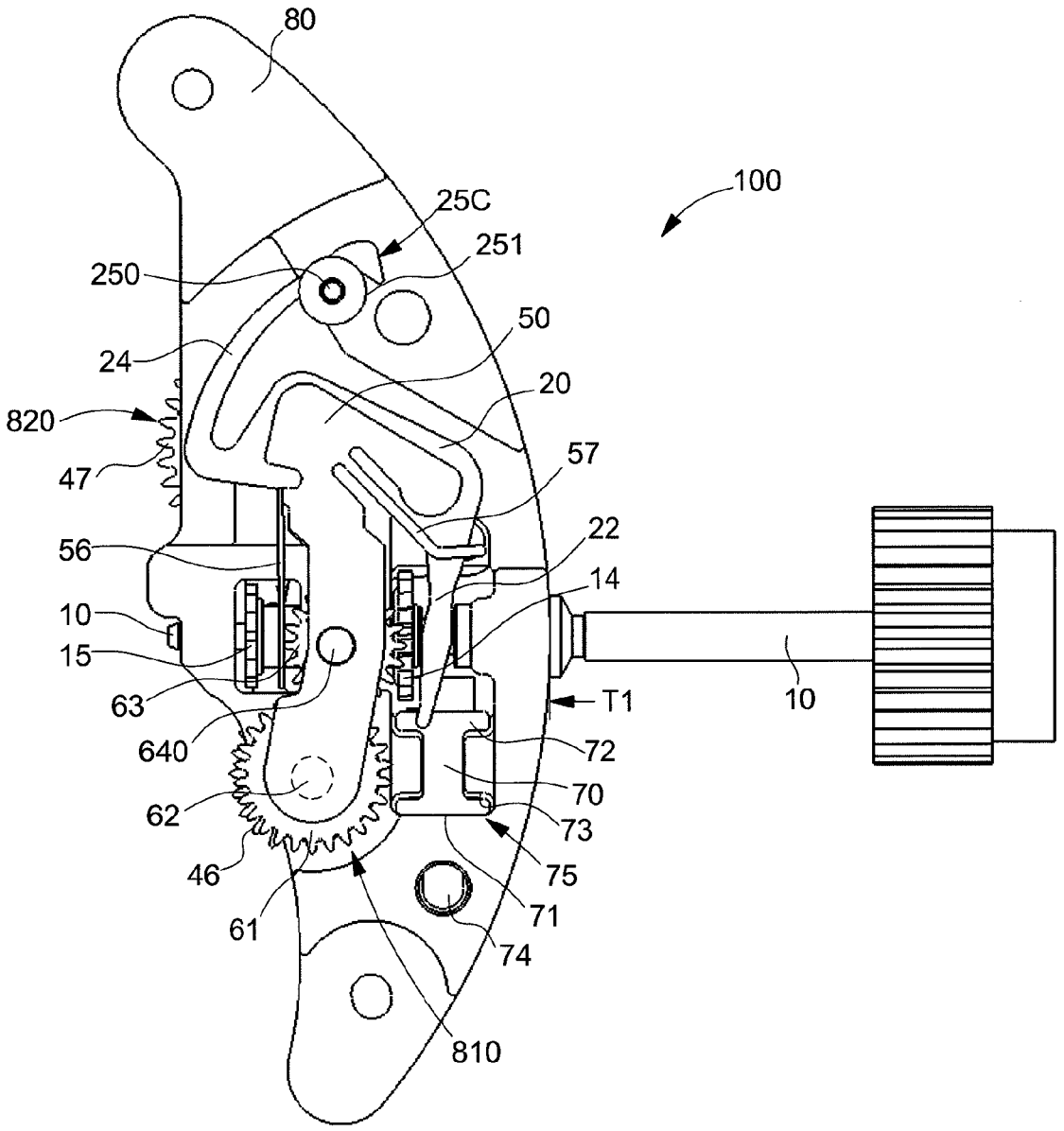
FIG. 2 shows a schematic, partial, front view of part of the mechanism of FIG. 1, seen from the same first, train side, in a first pushed-in position of the control stem.
Figure 2A:
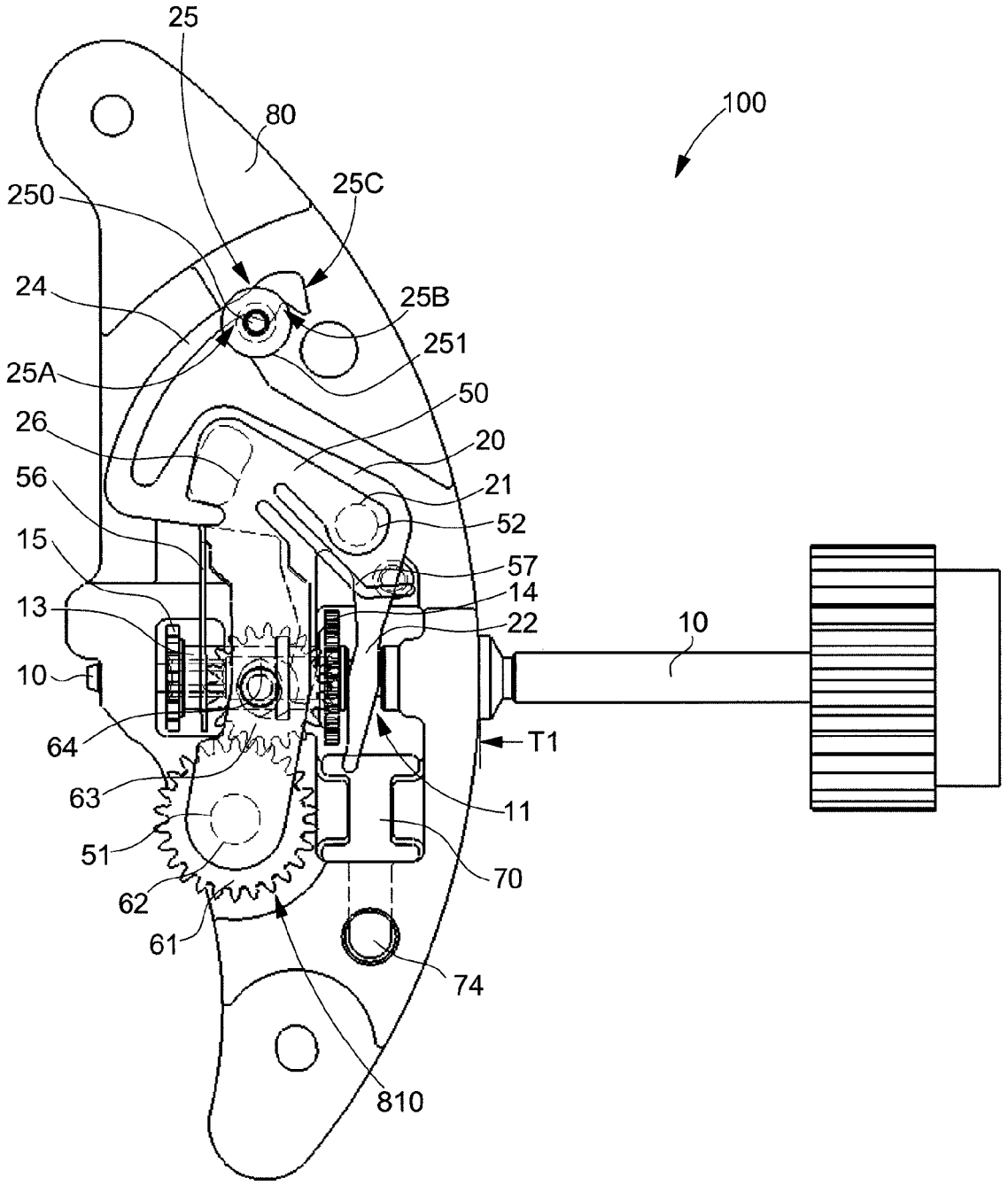
FIG. 2A shows certain components of the mechanism in dashed lines.
Figure 5:
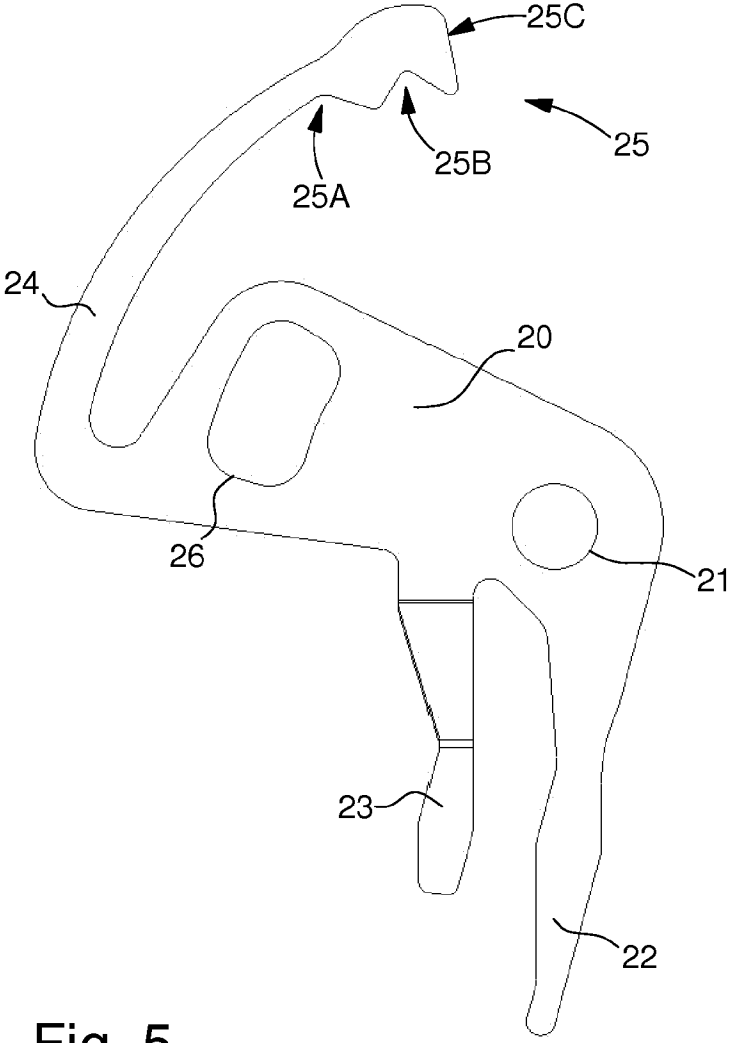
FIG. 5 shows a schematic, front view from the first, train side, of a pull-out piece comprised in the mechanism of FIG. 1.

FIG. 2A and FIG. 5 shows notches 25A, 25B, 25C, arranged to hold the pull-out piece for the pushed-in position T1 of control stem 10 in the case of FIG. 2, where notch 25A is cooperating with a pin 250 driven onto main bar 80, for the first pulled-out position T2 of control stem 10 in the case of FIG. 12, also corresponding to FIG. 14 and wherein notch 25B is cooperating with pin 250 and for the second pulled-out position T3 of control stem 10 in the case of FIG. 13, also corresponding to FIG. 15 and wherein notch 25C is cooperating with pin 250. In this particular case, notch 25C is formed simply by a slope at the end of flexible arm 24.

Pull-out piece 20 further comprises an oblong hole 26, arranged to cooperate, when pull-out piece 20 is pressed against main bar 80, with a boss 260 or a pin 126 comprised in main bar 80.

Control stem 10 includes, in a conventional manner, a guide means, such as an arbour of square section or similar, which cooperates with a complementary guide means, such as a female square, or flat portions, or similar, comprised in a sliding pinion 13, mounted on control stem 10, so as to allow a translation of said sliding pinion 13 relative to control stem 10 in a longitudinal direction in which control stem 10 can move relative to main bar 80, and so as to make sliding pinion 13 pivot integrally with control stem 10 relative to a pivot axis about which control stem 10 is arranged to pivot.

Figure 18:
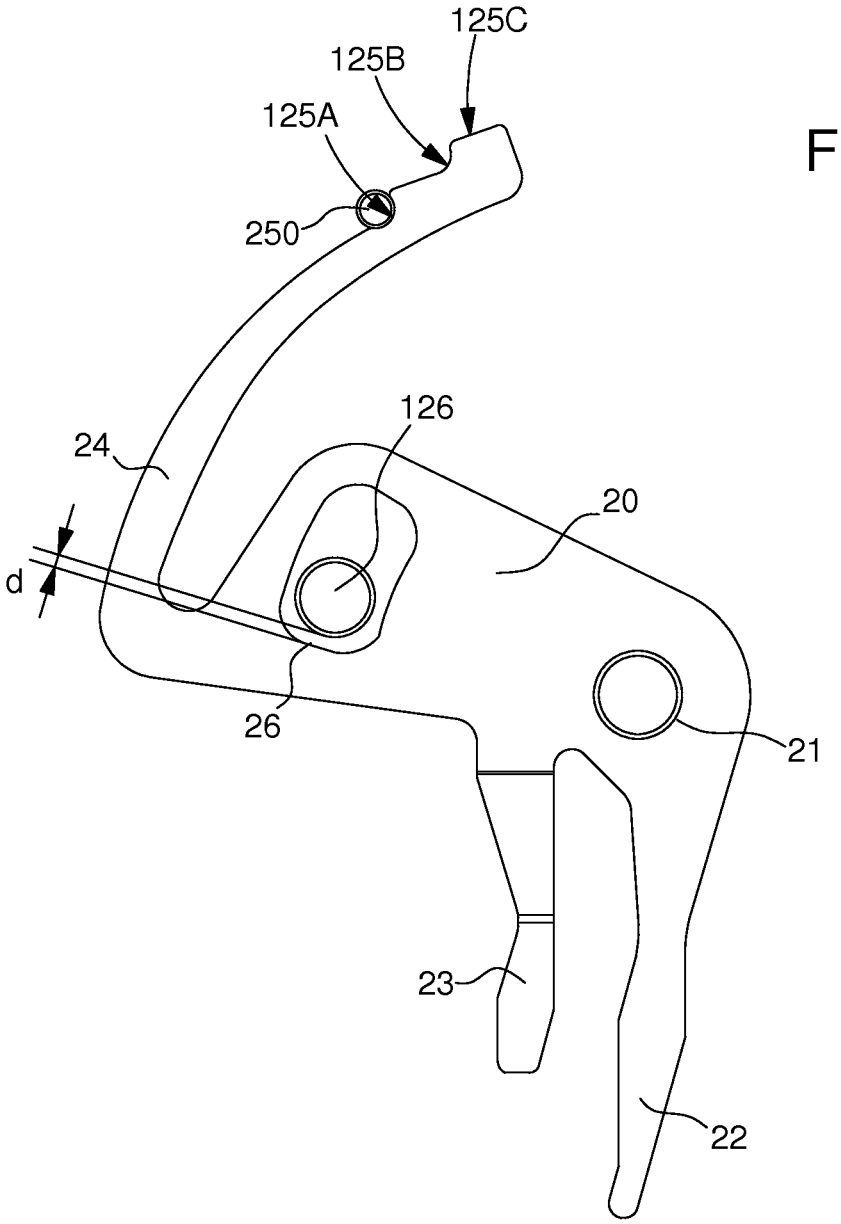
FIG. 18 shows, in a similar manner to FIG. 5, a schematic, front view from the first, train side of another pull-out piece model which may be included in the mechanism according to the invention.

FIG. 18 illustrates a variant of pull-out piece 20, wherein an external side of flexible arm 24 includes notches 125A, 125B, 125 C, which are arranged opposite pivot boss 210 housed in bore 21 of pull-out piece 20, whereas in the variant of FIG. 5, notches 25A, 25B, 25C are arranged on the inner side of arm 24 opposite said pivot. FIG. 18 shows the pushed-in position T1 of control stem 10, where notch 125A cooperates with pin 250 to maintain this position 1 alone. Pin 126, integral with the bottom plate, is then separated by a small distance d from the edge of hole 26. In the event of a shock, in particular to the stem, the shock drives pull-out piece 20, and is absorbed by the deformation of flexible arm 24 which forms a spring and hole 26 acts as a travel stop. The movement of a sliding pinion 13 is taken up by an almond-shaped bearing comprised in a stepped stud 64, which will be presented below.

Figure 3:
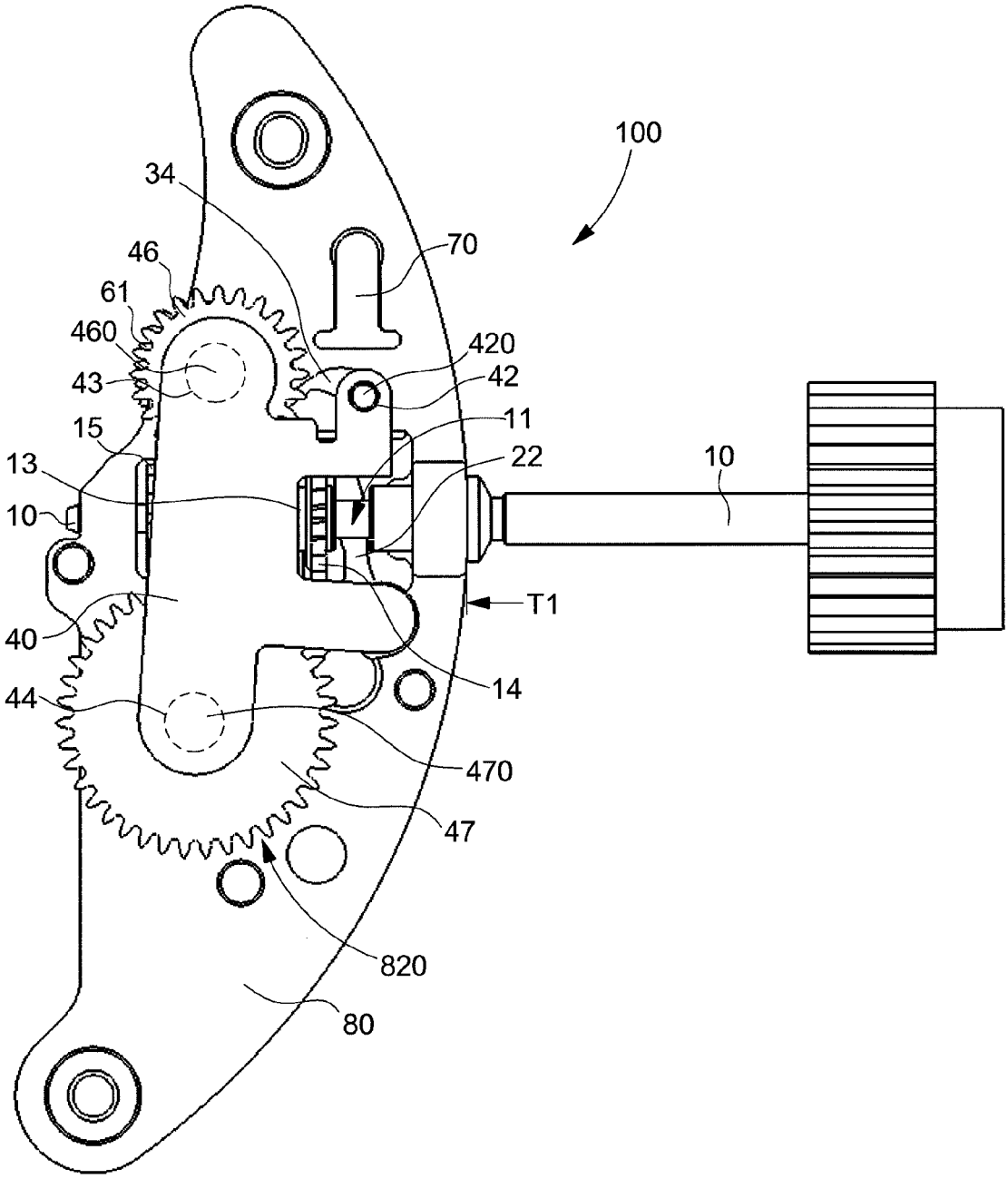
FIG. 3 shows a schematic, partial, front view of the mechanism of FIG. 1, seen from the second, dial side, in a first pushed-in position of the control stem.
Figure 3A:
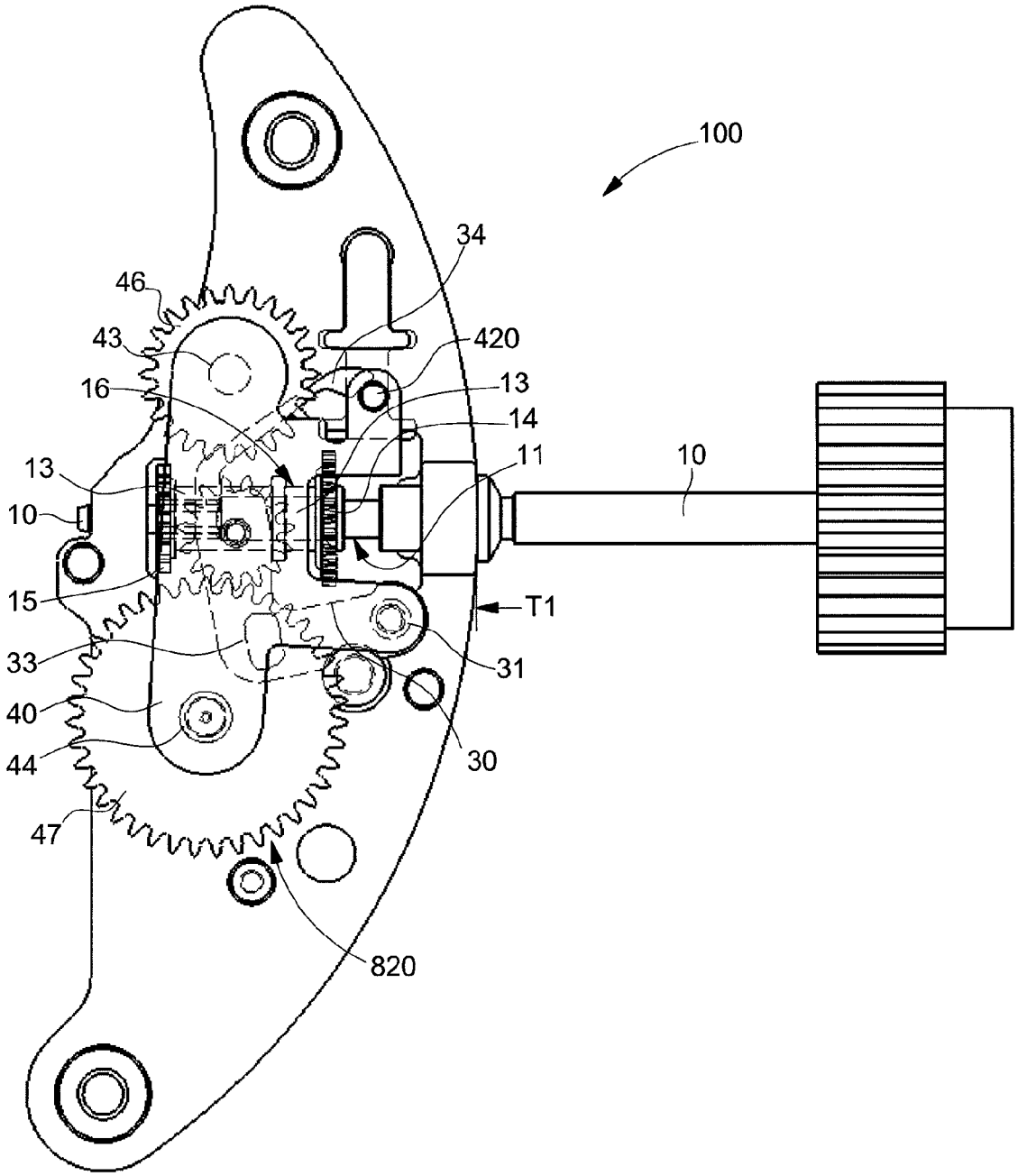
FIG. 3A shows certain components of the mechanism in dashed lines.

As seen in FIGS. 2 and 3, sliding pinion 13 further includes a first driving means 14, which is arranged to drive a first control train 810, or first control driving means. Sliding pinion 13 further includes a second driving means 15, arranged to drive a second control train 820, or second control driving means.

Control stem 10 includes a groove 11, as seen in FIG. 3, arranged to drive a first arm 22 comprised in pull-out piece 20, to move it from one stable pull-out piece position to another. Control stem 10 includes a stem bolt 19, for example in the form of a shoulder, which limits groove 11 on one side, and the abutment of first pull-out piece arm 22 prevents control stem 10 from being extracted in normal mode. According to the invention the only possible way of extracting control stem 10, as explained below, is to act on the elasticity of pull-out piece arm 22, and to deform said arm by moving it away from the axis of control stem 10 to allow said stem to be released.

Pull-out piece 20 further includes a second arm 23, which is arranged to cooperate with a groove 16 comprised in sliding pinion 13, seen in FIG. 14, to move sliding pinion 13 between a first position where the first driving means 14 cooperates with a first control train 810 or first control driving means, and a second position where the second driving means 15 cooperates with a second control train 820 or the second control driving means. In the first position of sliding pinion 13, the second driving means 15 does not cooperate with a second control train 820 or second control driving means, and, in the second position of sliding pinion 13, the first driving means 14 does not cooperate with a first control train 810 or first control driving means.

In a preferred implementation of the invention, as seen in the Figures, sliding pinion 13 is in a single piece, and comprises a first toothing 14, arranged to cooperate with a first idle wheel 63, called the crown wheel, for driving a first control train 810 or first control driving means. Likewise, at the opposite end of first toothing 14, sliding pinion 13 includes a second toothing 15, arranged to cooperate with the second idle wheel 36 to drive a second control train 820 or second control driving means.

Figure 4:
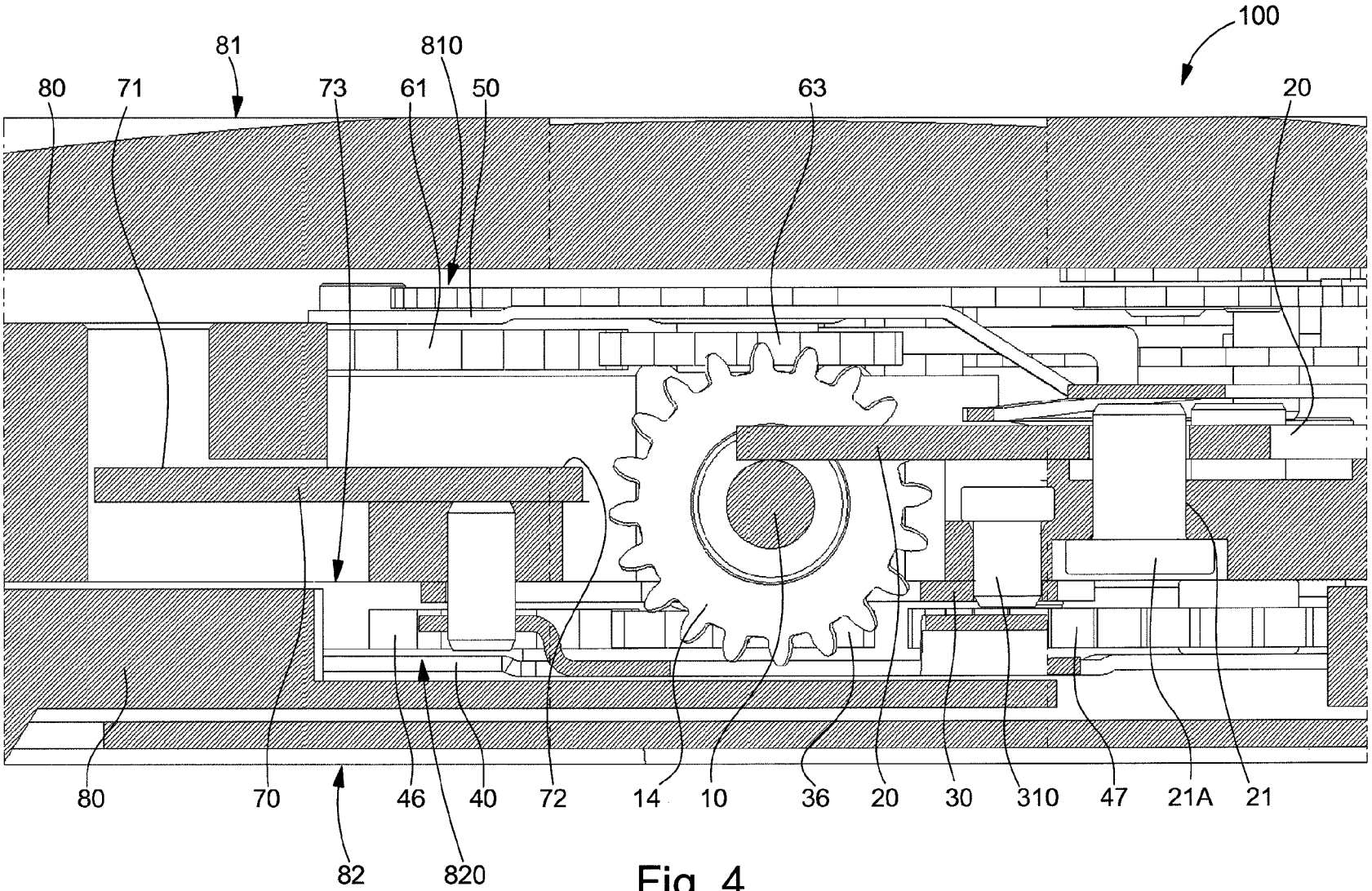
FIG. 4 shows a schematic, partial, cross-section of a detail of the mechanism, perpendicular to the main bar and to the control stem.

The first idle wheel 63 and second idle wheel 36 are located on two opposite sides of main bar 80, through the thickness of which control stem 10 and sliding pinion 13 pass. It is thus clear that sliding pinion 13 only meshes with one of these two idle wheels at a time. The meshing with each of the wheels occurs on two opposite sides of main bar 80, with two opposite toothings 14 and 15 of sliding pinion 13. In the embodiment illustrated in the Figures, the first idle wheel 63 can mesh with the first toothing 14 of sliding pinion 13, of first side 81, called the train side, of main bar 80, as seen in FIGS. 2 and 4. Whereas the second idle wheel 36 can mesh with the second toothing 15 of sliding pinion 13, on the second side 82, called the dial side, of main bar 80, as seen in FIG. 11.

Figure 11:
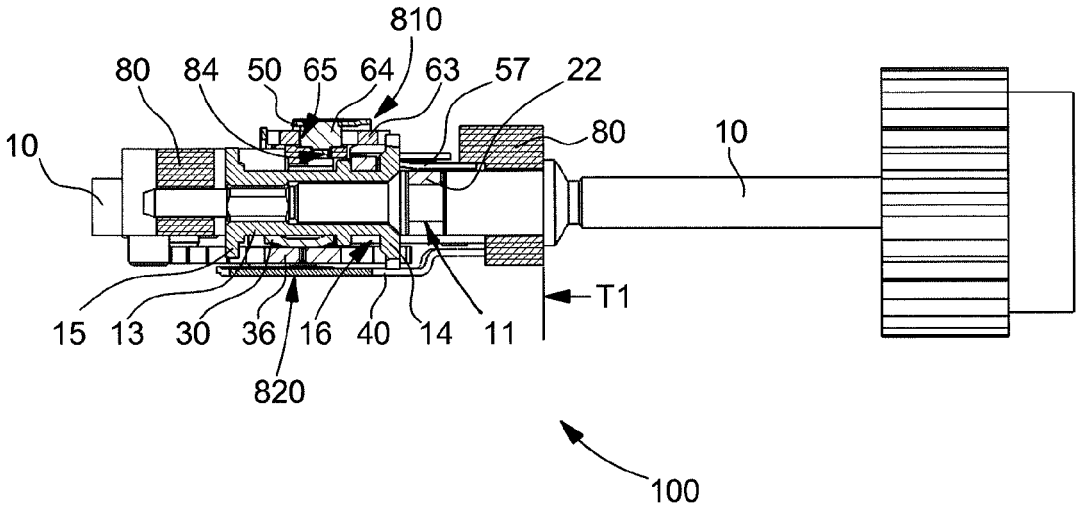
FIG. 11 is a partial, schematic view of the mechanism, in a cross-section passing through the axis of the control stem.
Figure 17:
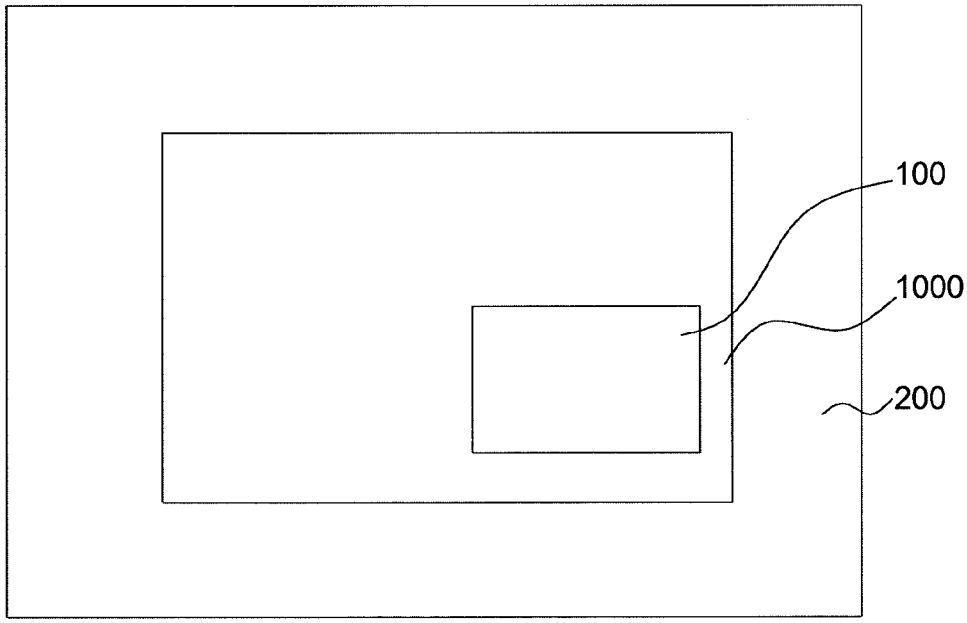
FIG. 17 shows block diagrams of a timepiece including a movement which includes a mechanism according to the invention.

Preferably, as seen in FIG. 11, the diameter of first toothing 14 of sliding pinion 13 is larger than that of second toothing 15. The difference in radius is slightly greater than the thickness of the first idle wheel 63, so that said idle wheel can pass above second toothing 15 of sliding pinion 13 when control stem 10 is in one of pulled-out positions T2 or T3.

This sliding pinion 13 can be made by injection, of metal or highly resistant plastic.

The design is simplified compared to ordinary winding mechanism. No Breguet toothing is required here which reduces the cost of the assembly.

Preferably, main bar 80, devised to be an injected part, particularly injected plastic, bears the maximum complexity, so that all the other components are as simple as possible. Main bar 80 includes studs or bosses absorbing stress relative to a bottom plate on which said bar is to be assembled.

The wheels and members which are pivotally moveable relative to main bar 80 are preferably pivotally mounted on steel pivots, which are driven into main bar 80.

Main bar 80 preferably includes a cylindrical cradle 83 for receiving a cylindrical shoulder of sliding pinion 13.

This cradle 83 further includes a bore 84 acting as a housing for a stepped stud 64, the function of which will be explained below.

Figure 6:
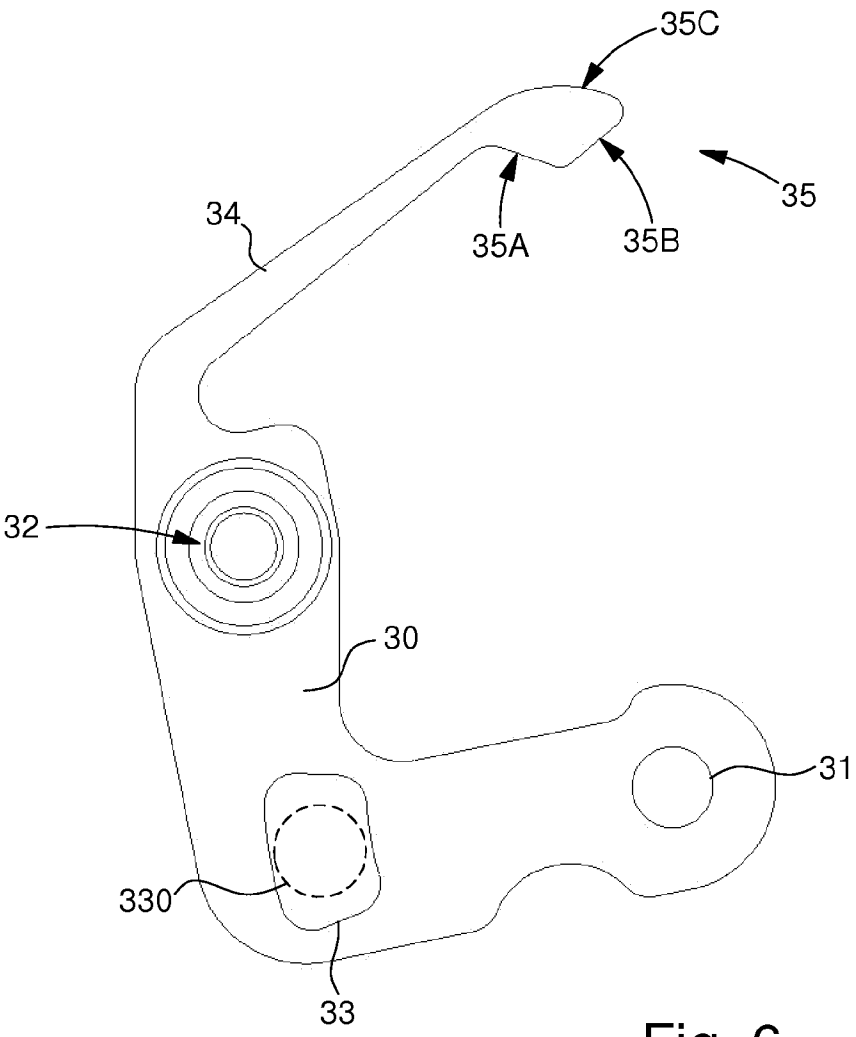
FIG. 6 shows a schematic, front view from the second, dial side of a lever comprised in the mechanism of FIG. 1.

Fitted to the first side 81 or second side 82 of said main bar 80, opposite the side carrying pull-out piece 20, autonomous control mechanism 100 includes a lever 30, shown in FIG. 6. This lever 30 is arranged to carry a second idle wheel 36, arranged to cooperate with the second driving means 15, to drive, according to the position of lever 30, one said second control train 820 or second control driving means, amongst a plurality of second control trains 820 or second control driving means.

Lever 30 is pivotally mounted, via a bore 31 comprised therein, on a boss 310 or pin comprised in main bar 80. Lever 30 is driven so as to pivot as a result of the movement of control stem 10 in a longitudinal direction, directly or indirectly via sliding pinion 13.

Figure 9:
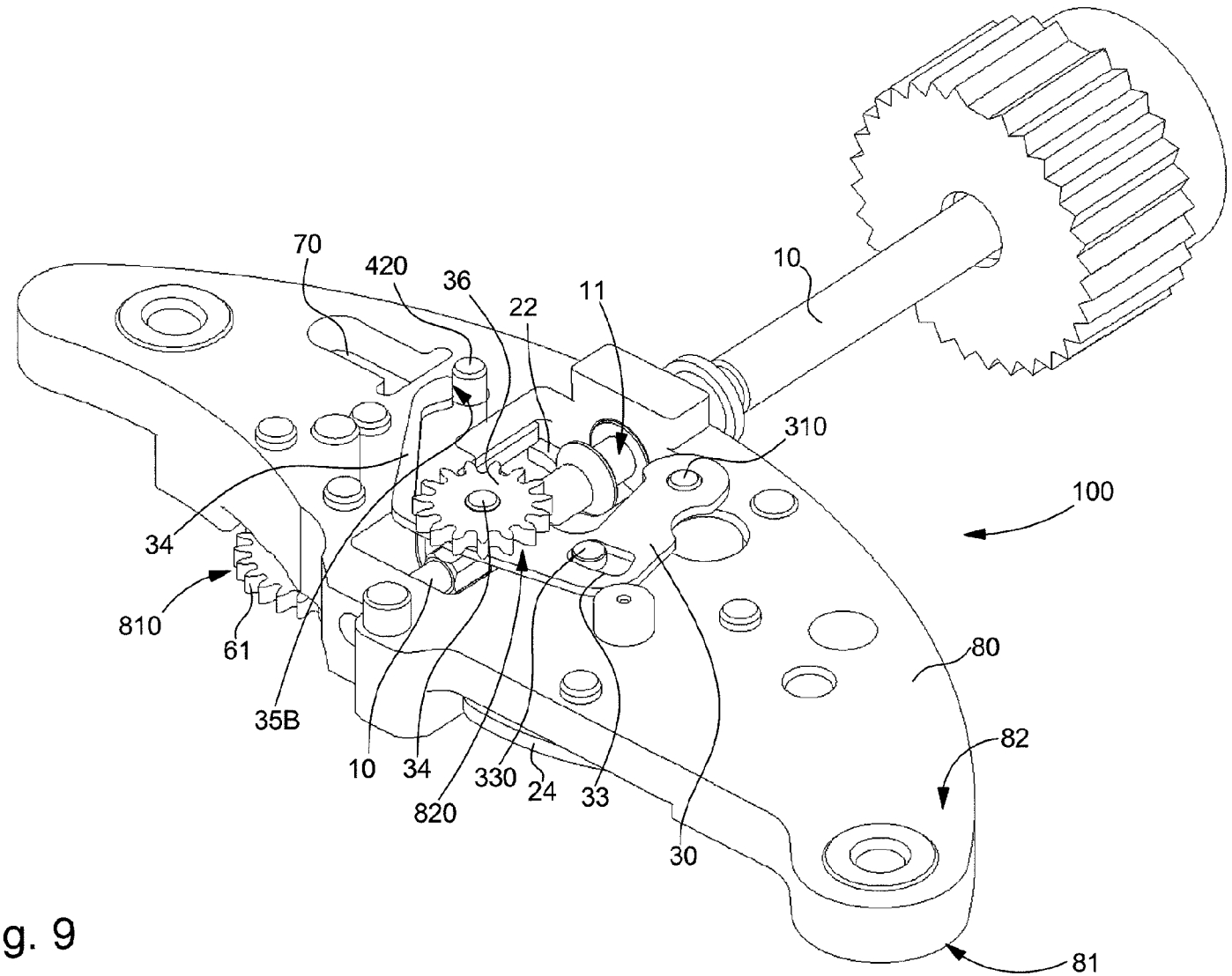
FIG. 9 shows a schematic, perspective view from the second, dial side of a detail of the cooperation of the lever of FIG. 6 with a main bar comprised in the mechanism.

As seen in FIG. 9, lever 30 includes an oblong hole 33, which cooperates with a stud 330 of main bar 80, which forms a limit stop for the travel of lever 30.

Lever 30 comprises a pivot carrying the second idle wheel 36. Said pivot is preferably made in the form of a stepped stud 32, a collar of which is used to maintain the recommended meshing distances with a first wheel 46 and a second wheel 47, with which the second idle wheel 36 can mesh alternately. This stud 32 can be made by skiving, or it may also be deep stamped with the actual lever 30.

In the particular embodiment illustrated in the Figures, main bar 80 carries a first boss 460 or pivot, which is arranged to guide the pivoting of a first wheel 46, comprised in one of the second control trains 820 or second control driving means. This first wheel 46 is arranged to mesh with the second idle wheel 36 in a first position of lever 30.

Main bar 80 carries a second boss 470 or pivot, which is arranged to guide the pivoting of a second wheel 47, comprised in one of the second control trains 820 or second control driving means. This second wheel 46 is arranged to mesh with the second idle wheel 36 in a second position of lever 30. Lever 30 is inserted between main bar 80 and first wheel 46 on the one hand, and second wheel 47 on the other hand.

The invention is illustrated for a particular embodiment where first wheel 46 controls the set hands mechanism of a movement 1000, and where second wheel 47 controls the date setting.

Lever 30 includes an elastic arm 34, a free end of which includes bearing surfaces 35, which are arranged to cooperate in a locking position with a boss 420 or pin comprised in main bar 80. FIGS. 6, 14 and 15 illustrate these bearing surfaces 35A and 35B, and their cooperation with a boss or pin 420 comprised in main bar 80. In FIG. 14, in a first pulled-out position T2 of control stem 10, lever 30 is driven so that the bearing surface 35B is abutting on boss 420, and lever 30 is then pivoted into a position where the second idle wheel 36 meshes with second wheel 47 in order to set the date. In FIG. 15, in a second pulled-out position T3 of control stem 10, lever 30 is driven such that bearing surface 35A is abutting on said boss 420, lever 30 is then pivoted into a position where the second idle wheel 36 meshes with first wheel 46 in order to set the time.

Autonomous control mechanism 100 includes a secondary bar 40, which is arranged to cover first wheel 46 and second wheel 47 on the side opposite lever 30. This secondary bar 40 is driven and/or welded at a bore 42*c* comprised therein to a boss 420 or pin of main bar 80. It is also secured, here via a lug 41 comprised therein, and particularly welded to a boss 310 or pin or main bar 80. In a variant it may also have a bore in said lug 41 driven and/or welded to said boss 310 or pin. These assemblies are arranged to be maintained by welds. This secondary bar 40 further includes a bore 43, arranged to receive an arbour 460 of a first wheel 46, particularly a first set hands wheel, and a bore 44 arranged to receive an arbour 470 of a second wheel 47, particularly a date wheel. It is also possible to fix the assemblies by a weld between secondary bar 40 and arbour 460 and/or arbour 470. In a variant, between bores 43 and 44, secondary bar 45 may also include a stamped oblong hole for holding lever 30 in the direction normal to its bearing surface, formed here by the second side 82 of main bar 80, so as to better ensure the meshing between sliding pinion 13 and the second idle wheel 36.

Figure 10:
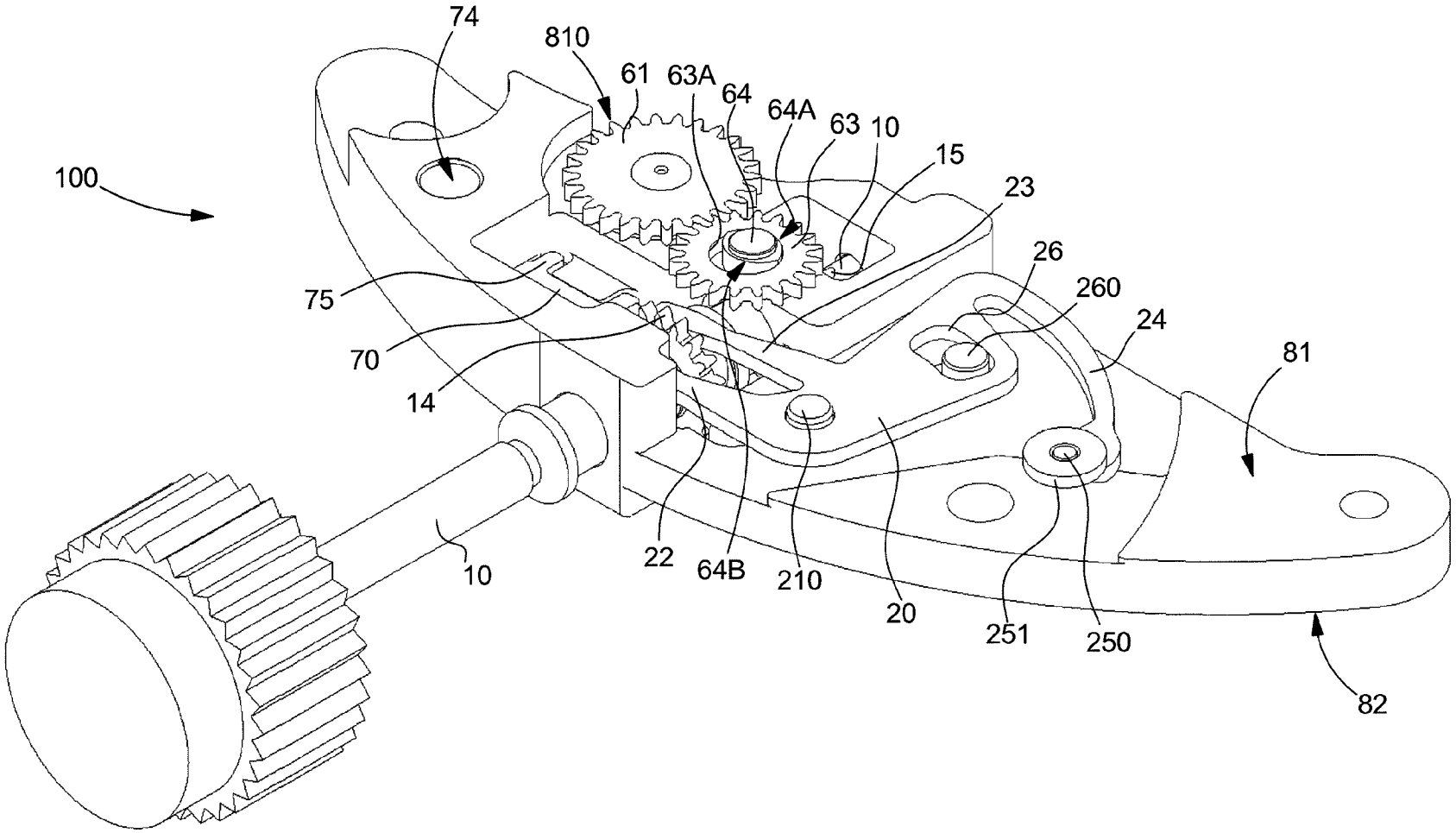
FIG. 10 shows a schematic, perspective view from the first, train side of a detail of the cooperation of a stepped stud with the bore of an idle wheel comprised in the mechanism.

On the side which carries pull-out piece 20, main bar 80 has a stepped stud 64, seen in FIGS. 2A and 10, for guiding a first idle wheel 63 via a bore 65 comprised therein. This first idle wheel 63, or crown wheel, is mounted in superposition with respect to pull-out piece 20, and arranged to cooperate with the first driving means 14, preferably the first toothing 14 of sliding pinion 13, to drive, according to the position of lever 30, one first control train 810 or first control driving means. This stepped stud 64 has an almond-shaped profile to allow the first idle wheel 63 to be positioned between two end positions: one wherein the first idle wheel 63 is meshed with the first driving means 14, and the other wherein the first idle wheel 63 is disengaged from said first driving means 14. This almond-shaped profile has two surfaces 64A, 64B seen in FIG. 10, which are two secant cylinder portions here. Each cooperates in turn in abutment with bore 63A of first idle wheel 63. The uncoupling function performed by this almond-shaped profile avoids any interfering tooth on tooth contact in the pulled-out position of control stem 10.

As shown in FIG. 2, main bar 80 carries a second boss 610 or pivot, arranged to guide the pivoting, via a bore 62, of an intermediate wheel 61, meshed with first idle wheel 63 and pressed onto main bar 80. This intermediate wheel 61 is, in particular, a ratchet driver for winding a barrel, not shown in the Figures.

Figure 8:
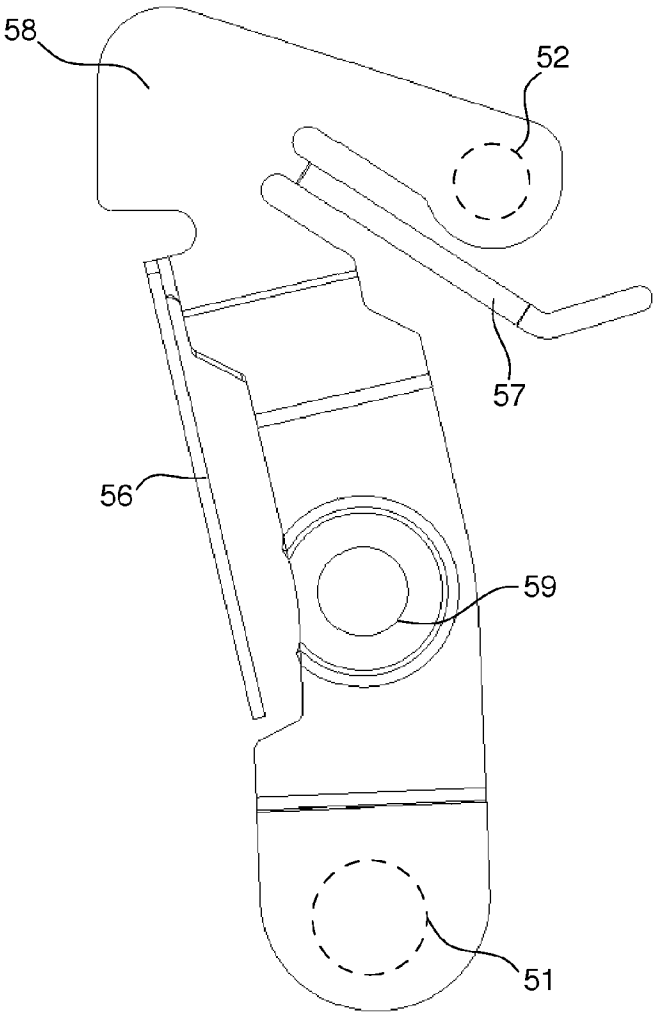
FIG. 8 shows a schematic, front view from the first, train side of a pull-piece holding plate of the mechanism of FIG. 1.
Figure 7:
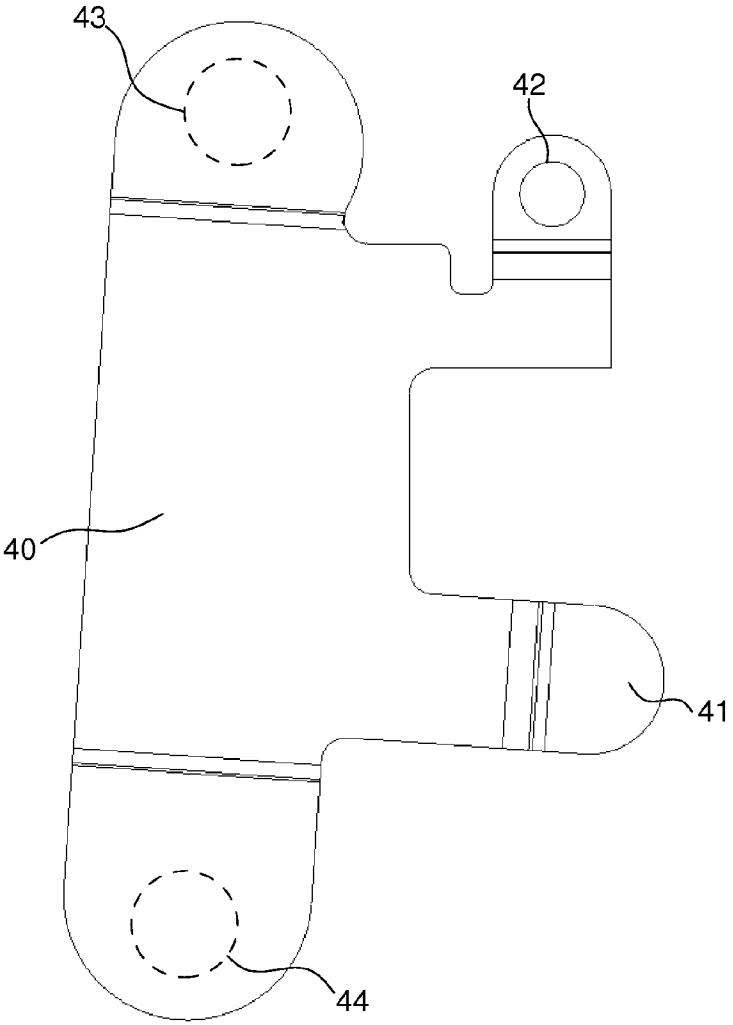
FIG. 7 shows a schematic, front view from the second, dial side of a secondary bar of the mechanism of FIG. 1.

Autonomous control mechanism 100 includes a pull-out piece holding plate 50, shown in FIG. 8 and visible in FIGS. 2 and 11. This pull-out piece holding plate 50 is arranged to cover the first idle wheel 63 and intermediate wheel 61, in superposition on pull-out piece 20, which is mounted trapped between main bar 80 and pull-out piece holding plate 50. The pull-out piece holding plate 50 may comprise, in a manner not shown in the Figures, a bore, or an oblong hole, or suchlike arranged to cooperate in alignment with a shoulder of stepped stud 64, so as to form an assembly aid, which may also be achieved optically, particularly using a camera. Pull-out piece holding plate 50 is preferably driven and/or welded onto the boss 210 or pin, at a bore 52, and on the boss 610 or pin at a bore 51.

Pull-out piece holding part 50 includes a first jumper spring arm 56, arranged to push the first idle wheel 63 and cause it to mesh with first driving means 14. The length of jumper arm 56 is sufficient to prevent any butting of one tooth of first idle wheel 63 on its free end. In another variant, not shown in the Figures, this jumper arm does not have a free end, and is formed by an arm of small section, held at both ends, of pull-out piece holding plate 50. In a variant, the first jumper arm 56 may be added, particularly by welding, to pull-out piece holding plate 50. This first jumper spring 56 avoids any risk of tooth on tooth contact when the stem is returned to its pushed-in position T1, which here is the winding position. The distance separating the toothing is achieved by selecting toothings of different diameters for first toothing 14 and second toothing 15 of sliding pinion 13.

Pull-out piece holding plate 50 includes a second jumper arm 57, which is arranged to push a first arm 22, comprised in pull-out piece 20, back towards main bar 80 to cooperate with a groove 11 in control stem 10, so as to hold up pull-out piece 20 relative to main bar 80 and to keep control stem 10 in one of the stable stem positions. This second jumper spring 57 thus ensures that pull-out piece 20 is held up and allows control stem 10 to be kept in a locked position, regardless of the position of the watch. Said control stem is held in position regardless of the position of mechanism 100 or movement 1000 in which mechanism 100 is integrated, or a timepiece 2000 in which mechanism 100 is integrated.

In a variant, instead of holding flexible arm 24 of pull-out piece 20 by a washer 251, as set out above, substantially in the extension of a first arm carrying bore 52 and second jumper spring 57, pull-out piece holding plate 50 may also comprise a support arm arranged to push said flexible arm 24 back towards main bar 80, to ensure the contact between notches 25 on the one hand, and the boss 250 or pin on the other hand.

Just like secondary bar 40, pull-out piece holding plate 50 is arranged to be secured by welding, particularly laser welding, to boss 610 or the pin on the one hand, and to pivot boss 210 of pull-out piece 20 on the other hand. Secondary bar 40 and pull-out piece holding plate 50 are preferably stepped plates comprising inclined faces, obtained by stamping. As components 40 and 50 are folded, rendering them elastic, it is possible to work with this elasticity during assembly to produce a pre-stress.

Advantageously, to facilitate the assembly and dismantling of control stem 10, main bar 80 has a housing 73 for receiving a lever 70. This lever 70 includes an operating arm 71, arranged to be pressed by the user and to move a support arm 72 away from main bar 80. Support arm 72 is arranged to separate main bar 80 from a free end of first arm 22 of pull-out piece 20. Main bar 80 includes a slot 75 for inserting said lever 70, which is substantially flat, perpendicularly to one of sides 81 or 82 of main bar 80. One end of the lever has projecting studs forming a hinge. This configuration enables insertion and tipping to be performed by a robot gripper or clamp. Once tipped, lever 70 is retained, in the direction of the thickness of main bar 80, by pull-out piece 20, and it is held in the other directions by housing 73 of main bar 80, which has a complementary profile. A support bar 74 enables the necessary pressure to be applied to tip lever 70 so as to raise pull-out piece 20, moving it away from the axis of control stem 10 and thus releasing said stem.

In mechanism 100, the toothing modules are selected to be as wide as possible, so as to improve the resistance of the teeth to the stress of use. The use of pivots with quite large diameters reduces the Hertz pressure and improves the wear behaviour of the modules. The design allows stamped toothings to be used, which is particularly economical.

The embodiment is illustrated here with a substantially flat main bar 80, with two substantially parallel faces. It is clear that the invention can be generally applied to any form of main bar or frame, on which components are arranged on different faces, said components cooperating alternatively with a control member arranged between the support faces. It is, for example, possible to envisage making main bar 80 in the form of a cube, sphere or other shape.

The various bosses used for centring or as pivots may be made in a single piece with main bar 80, instead of being added thereto.

The components can normally be assembled on each of the faces, in an assembly sequence which ensures that the components that have already been assembled are held during each intermediate stage, which means that any movement in space is possible with automated operating equipment.

Indeed, the assembly of the mechanism according to the invention shown in the Figures is particularly easy:

main bar 80 is fitted with all the bosses and pins used as pivots, which are not made in a single piece therewith, on a second side 82 of main bar 80;

sliding pinion 13 is arranged on cradle 83 of main bar 80, on said second side 82;

lever 30, pre-fitted with second idle wheel 36, is positioned on main bar 80, to pivot on boss 310, which is pre-assembled on main bar 80 or made in a single piece therewith, and flexible arm 34 of lever 30 is pressed in abutment on boss 420, which is pre-assembled on main bar 80 or made in a single piece therewith, in an angular position suitable for the assembly of one of the two wheels 47 or 46;

the second date corrector wheel 47 is mounted on boss 470, which is pre-assembled on main bar 80 or made in a single piece therewith, while second wheel 47 is pivoted to cause it to mesh with second idle wheel 36. Then the first, set hands wheel 46 is mounted in a similar manner on boss 460, which is pre-assembled on main bar 80 or made in a single piece therewith. Naturally, the order of assembly of these wheels can be reversed:

secondary bar 40 is mounted on boss 310, which is already in place, on boss 420 which is already in place, by centring bosses 460 and 470 which are pre-assembled in bores 43 and 44, and the secondary bar is then fixed by laser welding or a similar method, spot welds being sufficient.

At this stage, the second, dial side 82 is completely equipped. First side 81 is then equipped, either in succession, or in parallel by a second operator while second side 82 is being equipped:

main bar 80 is fitted with any bosses and pins used as pivots which are not made in a single piece therewith, on a first side 81 of main bar 80;

the stepped stud 64 is positioned in bore 84 of main bar 80, opposite the bottom of cradle 83;

lever 70 is inserted in slot 75, which is then tipped into its housing 73;

pull-out piece 20 is positioned to pivot on boss 210 which is pre-assembled on main bar 80 or made in a single piece therewith. Flexible arm 24 of pull-out piece 24 is pressed in abutment, via one of its notches 25, on pin 250, which is pre-assembled on main bar 80 or made in a single piece therewith, in an angular position such that second arm 23 of pull-out piece 20 cooperates with groove 16 of the pre-assembled sliding pinion 13. The oblong hole 26 of pull-out piece 20 is positioned around boss 620, which is pre-assembled on main bar 80 or made in a single piece therewith. First arm 22 of the pull-out piece covers the support arm 72 of lever 70;

the first idle wheel 63 is mounted on the pre-assembled stepped stud 64;

intermediate wheel 61 is mounted on boss 610, which is pre-assembled on main bar 80 or made in a single piece therewith, while said intermediate wheel 61 is pivoted to cause it to mesh with first idle wheel 63;

pull-out piece holding plate 50 is mounted on boss 610, which is already in place, and on bosses 210 and 260, which are already in place, and said pull-out piece holding plate 50 is then secured by laser welding or similar, with spot welds being sufficient.

At this stage, the first, dial side 81 is completely equipped.

It then remains only to press lever 70 onto support 74 to move first arm 22 away from pull-out piece 20 of main bar 80, to allow control stem 10 to be inserted into its housing, until groove 11, delimited by the stem bolt 19, cooperates with said first arm 22. Control stem 10 is then in place and the force on support 74 of lever 70 can be released. The assembly of control mechanism 100 is then complete.

The invention also concerns a timepiece movement 1000 including at least one autonomous control mechanism 100. This movement 1000 includes a plurality of mechanisms, each arranged to cooperate with one of the first control trains 810 or first control driving means, or with one of the second control trains 820 or second control driving means.

Mechanism 100 includes, on a first side 81 of said main bar 80, a first control train 810 including an intermediate ratchet drive wheel 61 for a winding mechanism comprised in said movement 1000, arranged to be actuated by the pivoting of said control stem 10 in a first pushed-in position T1 of said control stem 10, and, on a second side 82 of said main bar 80, two second control trains 820, one including a first control wheel 46 for setting a set hands mechanism comprised in said movement 1000, arranged to be actuated by the pivoting of control stem 10 in a third pulled-out position T3 of said control stem 10, and the other including a second control wheel 47 for setting a date mechanism comprised in movement 1000, arranged to be actuated by the pivoting of the control stem 10 in a second pulled-out position T2 of control stem 10.

The invention also concerns a timepiece 2000 including at least one such autonomous control mechanism 100, or including a timepiece movement 1000 of this type.

What is claimed is:

1. An autonomous timepiece control mechanism, comprising:

on a first side of a main bar or bridge, at least one first control train;

on a second side of said main bar, at least one second control train; and at least one control stem, which is moveable relative to said main bar between a plurality of stable positions, in order to pivot, in each said stable position, a single one of said control trains, wherein said stem controls the positioning of a pull-out piece, which is fitted to one side of said main bar and moveable relative to a boss of said main bar, in a stable position of the pull-out piece associated with each said stable position of the stem, and in which any movement applied to said stem by the user causes the pivoting movement of either one said first control train, or one said second control train, wherein said stem comprises guide means cooperating with complementary guide means of a sliding pinion for the translation of said pinion on said stem and in contact therewith, and for pivoting said sliding pinion integrally with said stem, wherein said sliding pinion comprises a first driving means arranged to drive one said first control train and a second driving means arranged to drive one said second control train, wherein, fitted to one side of said main bar opposite the side carrying said pull-out piece, said mechanism includes a first lever, arranged to carry a second idle wheel arranged to cooperate with said second driving means to drive, according to the position of said first lever, one said second control train amongst a plurality of said second control trains or second control driving means, wherein said first lever is pivotally mounted on a boss of said main bar, and is driven so as to pivot as a result of the longitudinal movement of said stem, directly or indirectly via said sliding pinion, and includes an elastic arm, a free end of which includes bearing surfaces arranged to cooperate in a locking position with a boss of said main bar, wherein said main bar carries a first boss arranged to guide the pivoting of a first wheel comprised in one of said second control trains, said first wheel being arranged to mesh with said second idle wheel in a first position of said first lever, wherein said main bar carries a second boss arranged to guide the pivoting of a second wheel comprised in one of said second control trains, said second wheel being arranged to mesh with said second idle wheel in a second position of said first lever, and further wherein said first lever is inserted between said main bar and said first wheel on the one hand, and said second wheel on the other hand.

2. The autonomous control mechanism according to claim 1, wherein said sliding pinion is a single piece and comprises a first toothing arranged to cooperate with a first idle wheel to drive one said first control train and a second toothing arranged to cooperate with said second idle wheel.

3. The autonomous control mechanism according to claim 1, wherein said autonomous control mechanism includes a secondary bar arranged to cover said first wheel and said second wheel, on the opposite side to said first lever, and wherein said secondary bar is driven onto said boss on the one hand, and onto said boss on the other hand.

4. The autonomous control mechanism according to claim 1, wherein said main bar includes, on the side that carries said pull-out piece, a stepped stud for guiding a first idle wheel, which is assembled in superposition with respect to said pull-out piece and arranged to cooperate with said first driving means, in order to drive, according to the position of said first lever, one said first control train or first control driving means, said stepped stud including an almond-shaped profile to allow the positioning of said first idle wheel between two end positions, one in which said first idle wheel is meshed with said first driving means, and the other in which said first idle wheel is disengaged from said first driving means.

5. The autonomous control mechanism according to claim 4, wherein said main bar carries a second boss or pivot arranged to guide the pivoting of an intermediate wheel meshed with said first idle wheel, and pressed onto said main bar.

6. The autonomous control mechanism according to claim 5, wherein it includes a pull-out piece holding plate arranged to cover said first idle wheel and said intermediate wheel in superposition to said pull-out piece, which is mounted trapped between said main bar and said pull-out piece holding plate, and wherein said pull-out piece holding plate is driven and/or welded onto said boss on the one hand, and onto said boss on the other hand.

7. The autonomous control mechanism according to claim 6, wherein said pull-out piece holding plate has a first jumper spring arm arranged to mesh said first idle wheel with said first driving means.

8. The autonomous control mechanism according to claim 6, wherein said pull-out piece holding plate 9 includes a second jumper arm, which is arranged to push a first arm, comprised in said pull-out piece, back towards said main bar to cooperate with a groove in said control stem, so as to hold up said pull-out piece relative to said main bar and to hold said control stem in one of said stable stem positions, regardless of the position of said mechanism or a movement in which said mechanism is integrated or a timepiece in which said mechanism is integrated.

9. The autonomous control mechanism according to claim 6, wherein said pull-out piece includes a flexible arm, a free end of which includes notches for fixing said pull-out piece in stable pull-out piece positions relative to a boss comprised in said main bar, and wherein said boss carries a washer arranged to push said flexible arm back towards said main bar to guarantee contact between said notches and said boss.

10. The timepiece mechanism including at least one autonomous control mechanism according to claim 1, wherein said movement includes a plurality of mechanisms, each arranged to cooperate with one of said first control trains or with one of said second control trains.

11. The timepiece movement according to claim 10, wherein said mechanism includes, on a first side of said main bar, a first control train including an intermediate ratchet drive wheel for a winding mechanism comprised in said movement, arranged to be actuated by the pivoting of said control stem in a first pushed-in position of said control stem, and, on a second side of said main bar, two second control trains, one including a first control wheel for setting a set hands mechanism comprised in said movement, arranged to be actuated by the pivoting of said control stem in a third pulled-out position of said control stem, and the other including a second control wheel for setting a date mechanism comprised in said movement, arranged to be actuated by the pivoting of said control stem in a second pulled-out position of said control stem.

12. The timepiece including at least one autonomous control mechanism according to claim 1, or including at least one timepiece mechanism according to claim 10.

13. The autonomous control mechanism according to claim 1, wherein said control stem includes a first groove arranged to drive a first arm of said pull-out piece to move said pull-out piece from one said stable pull-out piece position to another, and wherein said pull-out piece includes a second arm arranged to cooperate with a second groove of said sliding pinion to move said sliding pinion between a first position in which said first driving means cooperates with one said first control train and a second position in which said second driving means cooperates with one said second control train.

14. The autonomous control mechanism according to claim 13, wherein said main bar comprises a housing for receiving a second operative lever which has an operating arm arranged for receiving pressure from a user and to move a support arm away from said main bar, said support arm being arranged to move said main bar away from a free end of said first arm of said pull-out piece.

* * * * *